US010128564B2

(12) United States Patent
Walker

(10) Patent No.: US 10,128,564 B2
(45) Date of Patent: Nov. 13, 2018

(54) SYSTEM AND APPARATUS FOR CLOTHING WITH EMBEDDED PASSIVE REPEATERS FOR WIRELESS COMMUNICATION

(71) Applicant: Michael Clyde Walker, Coronado, CA (US)

(72) Inventor: Michael Clyde Walker, Coronado, CA (US)

( * ) Notice: Subject to any disclaimer, the term of this patent is extended or adjusted under 35 U.S.C. 154(b) by 292 days.

(21) Appl. No.: 15/009,655

(22) Filed: Jan. 28, 2016

(65) Prior Publication Data

US 2016/0149293 A1 May 26, 2016

Related U.S. Application Data

(63) Continuation-in-part of application No. 14/162,357, filed on Jan. 23, 2014, now Pat. No. 9,627,772, which is a continuation of application No. 13/856,250, filed on Apr. 3, 2013, now abandoned, which is a continuation of application No. 12/884,056, filed on Sep. 16, 2010, now abandoned.

(60) Provisional application No. 62/125,841, filed on Feb. 2, 2015, provisional application No. 61/373,222, filed on Aug. 12, 2010, provisional application No. 61/243,120, filed on Sep. 16, 2009.

(51) Int. Cl.

| | |
|---|---|
| ***H01Q 1/27*** | (2006.01) |
| ***H01Q 9/16*** | (2006.01) |
| ***H01Q 19/30*** | (2006.01) |
| ***H01Q 25/00*** | (2006.01) |

(52) U.S. Cl.
CPC ..... *H01Q 1/273* (2013.01); *H01Q 9/16* (2013.01); *H01Q 19/30* (2013.01); *H01Q 25/005* (2013.01)

(58) Field of Classification Search
CPC ..... H01Q 1/273; H01Q 9/26–9/27; H01Q 19/108
See application file for complete search history.

(56) References Cited

U.S. PATENT DOCUMENTS

| | | | | |
|---|---|---|---|---|
| 6,795,975 | B2 * | 9/2004 | Marmaropoulos .... | H01Q 1/273 2/69 |
| 9,628,924 | B2 * | 4/2017 | Bauman ..... | H04R 25/554 |
| 2011/0063181 | A1 * | 3/2011 | Walker ..... | H01Q 9/16 343/803 |

* cited by examiner

*Primary Examiner* — Jessica Han
*Assistant Examiner* — Amal Patel
(74) *Attorney, Agent, or Firm* — IDP Patent Services; Olav M. Underdal

(57) ABSTRACT

A passive repeater garment includes a clothing item and a plurality of flexible antenna apparatuses, each including an electromagnetically reflective layer; an insulation layer, which can be dielectric; an arrangement of conductors, including a first antenna, a second antenna, a coupling element, a reflector; an antenna layer; and a protective cover layer. The conductors can be made from conductive threads. The first and second antennas can include a dipole antenna, a rhombic antenna, a planar antenna, or a Yagi-Uda antenna, and an undulating portion. Also disclosed is a system of passive repeater garments, including a plurality of personal assemblies of passive repeater garments, each assembly configured for a human user, and including a plurality of passive repeater garments.

36 Claims, 19 Drawing Sheets

System of passive repeater garments

Signal Propagation

SYSTEM AND APPARATUS FOR CLOTHING WITH EMBEDDED PASSIVE REPEATERS FOR WIRELESS COMMUNICATION

CROSS-REFERENCE TO RELATED APPLICATIONS

This application claims the benefit of U.S. Provisional Application No. 62/125,841, filed Feb. 2, 2015. Additionally, this application is a continuation-in-part of U.S. Non-Provisional application Ser. No. 14/162,357, filed Jan. 23, 2014, which is a continuation of U.S. Non-Provisional application Ser. No. 13/856,250, filed Apr. 3, 2013, which is a continuation of U.S. Non-Provisional application Ser. No. 12/884,056, filed Sep. 16, 2010, which claims priority from U.S. Provisional Application No. 61/373,222, filed Aug. 12, 2010, and U.S. Provisional Application No. 61/243,120, filed Sep. 16, 2009.

FIELD OF THE INVENTION

The present invention relates generally to the field of wireless communications technology, and more particularly to methods, devices, and systems for flexible fabric antennas, which are embedded into clothing in order to function as passive repeaters for transmission of wireless signals.

BACKGROUND OF THE INVENTION

Growing demand for high-rate wireless data services continues to drive the growth of wireless networks. One factor fostering the rapid growth of wireless networks is the growing demand for high-rate data services to be accessible from virtually any location, at all times.

However, despite the efforts of network operators and consumer equipment makers to provide seamless wireless communication coverage, areas of weak signal strength still exist, even in richly serviced areas such as urban centers. The areas of weak signal strength, sometimes referred to as null spots or dead spots, are sometimes caused by the density and material composition of vehicles, buildings and other structures in a wireless coverage area. For example, within a substantially enclosed environment, such as a vehicle or building, the materials of the vehicle or building can cause shadowing, shielding and/or multipath interference that deteriorate radio frequency (RF) signals.

In a vehicle or building, for example, the metal body and/or frame of a vehicle or structural metal and/or reflective windows of a building creates a shielding effect that attenuates radio signals within the vehicle or building. In a dense urban area, the surrounding buildings create a multipath environment where signal reflections destructively combine in locations that are difficult to predict. The destructive interference reduces receivable RF signals to the point where wireless communication can be virtually impossible at the frequency and power levels used in the wireless system. In other situations, the structures themselves acts as barriers that significantly attenuate signal strength of RF signals to the point where the RF signal strength within the structure is lower than is desirable for reliable service.

As such, considering the foregoing, it may be appreciated that there continues to be a need for novel and improved devices and methods for improving wireless communication coverage, particularly in areas with weak signal strength.

SUMMARY OF THE INVENTION

The foregoing needs are met, to a great extent, by the present invention, wherein in aspects of this invention, enhancements are provided to the existing model of devices and systems for enhancing wireless connectivity.

In an aspect, a passive repeater garment, includes a clothing item and a plurality of antenna apparatuses, which are mounted to the clothing item.

In another aspect, a system of passive repeater garments, can include a plurality of personal assemblies of passive repeater garments, such that each personal assembly is configured for use by a human user and includes a plurality of passive repeater garments.

In some related aspects, an antenna apparatus can include an electromagnetically reflective layer plane, the electromagnetically reflective layer having first and second faces; a first insulating or dielectric layer disposed on the first face of the electromagnetically reflective layer; and a first arrangement of conductors disposed on the first dielectric layer. The first arrangement of conductors can include a first resonator including a first antenna having a respective feed point, a second antenna having a respective feed point, and a first coupling element electrically connecting the respective feed points of the first and second antennas. The first arrangement of conductors can include a first reflector electrically isolated from the first resonator and positioned adjacent to at least one of the first and second antennas. The longitudinal axis of the first reflector can intersect the first coupling element.

In further related aspects, the first and second antennas can be folded dipole antennas. The respective feed point for each of the first and second antennas comprises first and second feed terminals. Additionally, the coupling element includes first and second conductive traces, the first conductive trace electrically connecting the respective first feed terminals of the first and second antennas, and the second conductive trace electrically connecting the respective second feed terminals of the first and second antennas. In some embodiments, at least one of the first and second antennas includes an undulating portion.

In other related aspects, the first arrangement of conductors can also include a second reflector electrically isolated from the first resonator and positioned adjacent to the second antenna. The longitudinal axis of the second reflector can intersect the first coupling element. In that embodiment, the first reflector is positioned adjacent to the first antenna.

In yet other aspects, the antenna apparatus can include a second insulating or dielectric layer disposed on the second face of the electromagnetically reflective layer; and a second arrangement of conductors disposed on the second dielectric layer. The second arrangement of conductors includes a second resonator including a third antenna having a respective feed point, a fourth antenna having a respective feed point, and a second coupling element electrically connecting the respective feed points of the third and fourth antennas; and a second reflector electrically isolated from the second resonator and positioned adjacent to at least one of the third and fourth antennas, and wherein the longitudinal axis of the second reflector intersects the second coupling element.

In some aspects, the antenna apparatus includes a conductive connector extending through the first dielectric layer, the electromagnetically reflective layer and the second dielectric layer, the conductive connector electrically connecting the first and second coupling elements; and a dielectric separator interposed between the electromagnetically reflective layer and the conductive connector, thereby electrically isolating the electromagnetically reflective layer and the conductive connector.

One aspect of the disclosure is an antenna apparatus including a electromagnetically reflective layer; a dielectric layer on the electromagnetically reflective layer; a plurality of antennas arranged on the dielectric layer in a respective plurality of directions, each of the plurality of antennas having a feed point; at least one coupling element, wherein each coupling element electrically connects the respective feed points of a respective pair of antennas; and at least one reflector electrically isolated from the plurality of antennas and positioned adjacent to at least one of the plurality of antennas, and wherein the respective longitudinal axis of at least one reflector intersects the first coupling element.

In other aspects, each of the plurality of antennas is a folded dipole antenna, and the respective feed point for each antenna comprises first and second feed terminals, and wherein each coupling element includes first and second conductive traces, the first conductive trace electrically connecting the respective first feed terminals of a pair of antennas, and the second conductive trace electrically connecting the respective second feed terminals of the same pair of antennas.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

Some embodiments provide a relatively small antenna apparatus that acts as a passive repeater. The antenna apparatus can be designed to facilitate radio frequency (RF) signal gain for a collection or range of frequencies. Some embodiments are configured to be used with mobile phone networks (e.g., networks operating at 1.920 GHz or other frequencies), wireless data networks (e.g., Wi-Fi networks operating at 2.4 GHz and/or 5.8 GHz), other frequencies, or combinations of frequencies. In some embodiments, the antenna apparatus is placed within a short range, such as, for example, a distance of about 6-24 inches, of a device with a wireless receiver and/or transmitter, where the antenna apparatus causes increased RF signal intensity at the device by coupling RF signals from a proximate area of higher RF signal intensity into the area around the device. Other configurations and ranges are possible, and, in some embodiments, increased RF signal intensity can extend over larger distances. Accordingly, in some instances, an embodiment of the antenna apparatus can be used to increase the RF signal intensity in a null spot or dead spot by coupling RF signal energy from an area proximate to the null spot that has higher RF signal intensity.

Figure 1A:
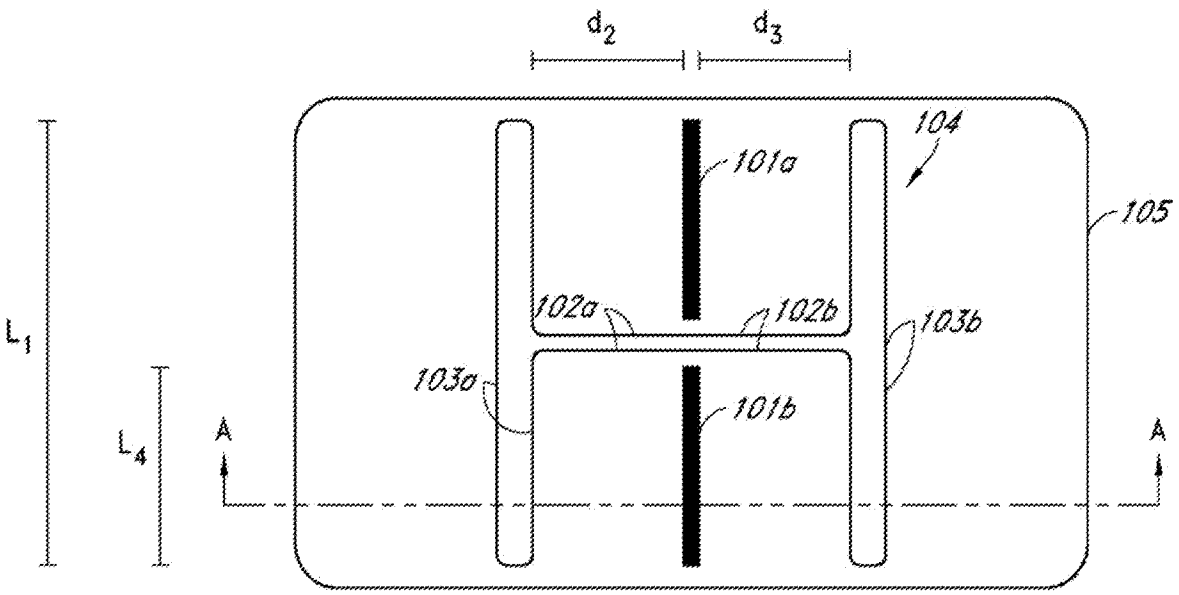
FIG. 1A is a plan view of an antenna apparatus, according to an embodiment of the invention.
Figure 1B:
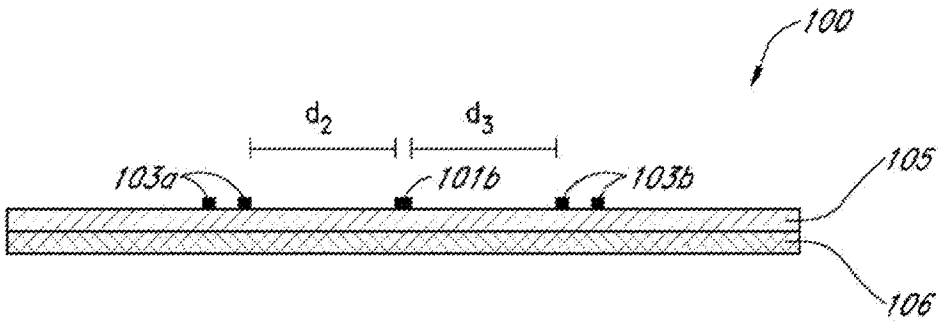
FIG. 1B is a cross-sectional view of the antenna apparatus of FIG. 1A taken along line A-A, according to an embodiment of the invention.

In an embodiment, FIG. 1A shows a plan view of an antenna apparatus 100, and FIG. 1B shows a cross-sectional view of the antenna apparatus 100 in FIG. 1A taken along line A-A.

In a related embodiment, the antenna apparatus 100 illustrated in FIGS. 1A and 1B includes:

a) an electromagnetically reflective layer 106;

b) an insulating layer 105 disposed adjacent to the electromagnetically reflective layer 106; and c) an arrangement of conductors disposed on the insulating layer 105;

In the illustrated embodiment, the insulating layer 105 is disposed between the arrangement of conductors and the electromagnetically reflective layer 106. As described in further detail below, the arrangement of conductors includes a resonator 104 and a reflector comprising first and second portions 101 *a*, 101 *b*.

In related embodiments, the insulating layer 105, can be a dielectric layer 105.

In some embodiments, the electromagnetically reflective layer 106 includes a rigid conductive plate. For example, the conductive plate can be, without limitation, a plate of aluminum, copper, another metal, a metal alloy, conductive ceramic, a conductive composite material having a thickness sufficient to be substantially rigid, another suitable material, or a combination of materials. In some embodiments, the electromagnetically reflective layer 106 is flexible. For example, the electromagnetically reflective layer 106 can be, without limitation, a plate of aluminum, copper, another metal, a metal alloy, a conductive ceramic and/or a conductive composite material having a thickness sufficient to be substantially flexible. Additionally, the composite material may include a conductive thread including one or more metals and/or metal alloys woven to form a plane or sheet. Additionally, and/or alternatively, the electromagnetically reflective layer can be a heterogeneous structure including a combination of dielectric and conductive portions, but nevertheless remaining substantially reflective to electromagnetic energy.

The resonator 104 includes first and second antennas 103 *a*, 103 *b* electrically connected by a coupling element. For the sake of facilitating the present description only, the coupling element is labeled as having two portions 102 *a*, 102 *b*. In the antenna apparatus 100, the two portions of the coupling element 102 *a*, 102 *b* can be arranged so as to be collinear, forming a straight conductive path between the first and second antennas 103*a* 103*b*.

The reflector includes first and second portions 101 *a*, 101 *b* separated by a gap through which the coupling element extends and intersects the longitudinal axis of the reflector. In some embodiments, the reflector is a single conductor (not shown), and the antenna apparatus 100 further includes a dielectric separator 220 *a*, 220 *b* (shown in FIG. 2B) between the reflector 101 *c*, 101 *d* and the coupling element 102 *c*, 102 *d*. The dielectric separator 220 *a*, 220 *b* is provided to electrically isolate the reflector 101 *c*, 101 *d* and the coupling element 102 *c*, 102 *d*. In other words, the dielectric separator 220 *a* 220 *b* prevents the reflector 101 *c*, 101 *d* from shorting to the coupling element 102 *c*, 102 *d*.

The first and second antennas 103 *a*, 103 *b* are folded dipole antennas, and the respective feed point of each of the first and second antennas 103 *a*, 103 *b* includes respective first and second feed terminals. Accordingly, the two portions of the coupling element 102 *a*, 102 *b* include first and second parallel conductive traces. The first conductive trace electrically connects the respective first feed terminals of the first and second antennas 103 *a*, 103 *b*. The second conductive trace electrically connects the respective second feed terminals of the first and second antennas 103 *a*, 103 *b*.

Each of the first and second folded dipole antennas 103 *a*, 103 *b* is defined by a length $L_1$. The tips of a folded dipole antenna are folded back until they almost meet at the feed point, such that the antenna comprises one entire wavelength. Accordingly, so long as the first and second feed point terminals are sufficiently close to one another, the wavelength of each of the first and second folded dipole antennas 103 *a*, 103 *b* is $2L_1$. Those skilled in the art will appreciate that this arrangement has a greater bandwidth than a standard half-wave dipole. Moreover, the length of each of the first and second portions of the reflector 101 *a*, 101 *b* is length $L_4$, which is approximately $\frac{1}{2}L_1$. However, while the first and second reflector portions 101 *a*, 101 *b* are approximately the same length in FIG. 1A, in other embodiments, the first and second reflector portions 101 *a*, 101 *b* are different lengths. The lengths of the first and second antennas can be used to determine the dimensions of the antenna apparatus 100.

For example, some embodiments are configured to be used with mobile phone networks (e.g., networks operating at 1.920 GHz or other frequencies), wireless data networks (e.g., Wi-Fi networks operating at 2.4 GHz and/or 5.8 GHz), other frequencies, or combinations of frequencies. As such, the wavelengths associated with such frequencies could be used to define $L_1$, as being a quarter, a half or full wavelength associated with the center frequency of the band.

Additionally, the first folded dipole antenna 103 *a* is spaced from the reflector portions 101 *a*, 101 *b* by a distance $d_2$, and the second folded dipole antenna 103 *b* is spaced from the reflector portions 101 *a*, 101 *b* by a distance $d_3$. The distances $d_2$, $d_3$ can be equal or different. However, those skilled in the art will appreciate that an asymmetric spacing will have an impact on the radiation pattern of the antenna apparatus 100.

While the first and second antennas 103 *a*, 103 *b* illustrated in FIG. 1A are folded dipole antennas those skilled in the art will appreciate from the present disclosure that the first and second antennas 103 *a*, 103 *b* can be each individually configured, without limitation, as one of a monopole antenna, a dipole antenna, a rhombic antenna, a planar antenna, and a Yagi-Uda antenna. Those skilled in the art will appreciate that the radiation pattern of the resulting antenna apparatus will change as a function of the antenna types chosen for the respective first and second antennas 103 *a*, 103 *b*.

Figure 1C:
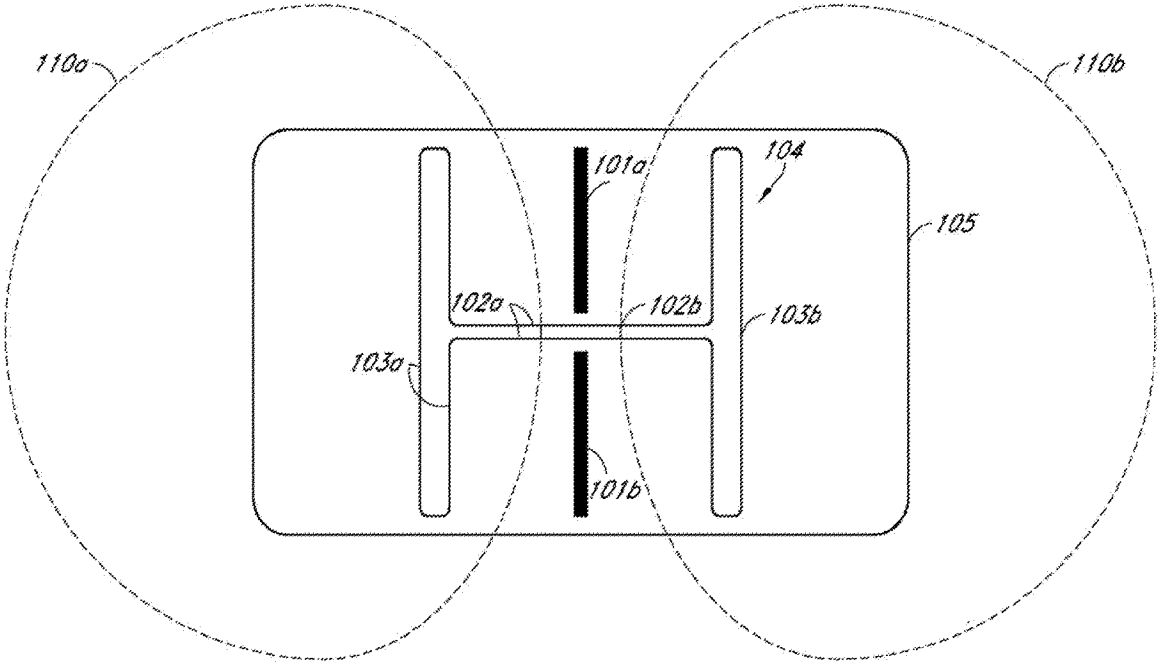
FIG. 1C is the plan view of the antenna apparatus of FIG. 1A illustrated with an approximation of the radiation pattern of the antenna apparatus, according to an embodiment of the invention.

In a related embodiment, FIG. 1C shows the plan view of the antenna apparatus 100 of FIG. 1A illustrated with an approximation of the radiation pattern of the antenna apparatus.

Figure 1D:
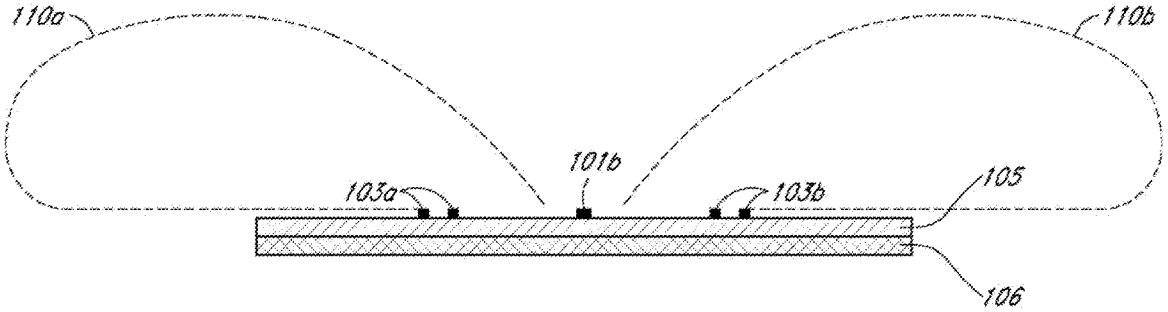
FIG. 1D is the cross-sectional view of the antenna apparatus of FIG. 1B, shown with an approximation of the radiation pattern of the antenna apparatus, according to an embodiment of the invention.

Similarly, FIG. 1D is the cross-sectional view of the antenna apparatus 100 shown with a cross-sectional view of the same approximation of the radiation pattern of the antenna apparatus 100.

With reference to both FIGS. 1C and 1D, the reflector portions 101 *a*, 101 *b* distort the toroidal radiation patterns of the first and second folded dipole antennas 103 *a*, 103 *b*. For the first folded dipole antenna 103 *a*, the result is a radiation pattern approximated by the dashed line 110 *a* in FIGS. 1C and 1D. For the second folded dipole antenna 103 *b* the result is a radiation pattern approximated by the dashed line 110 *b* in FIGS. 1C and 1D. In operation, RF signals received by one of the antennas are coupled through the coupling element and propagated by through the respective radiation pattern of the other.

Figure 2A:
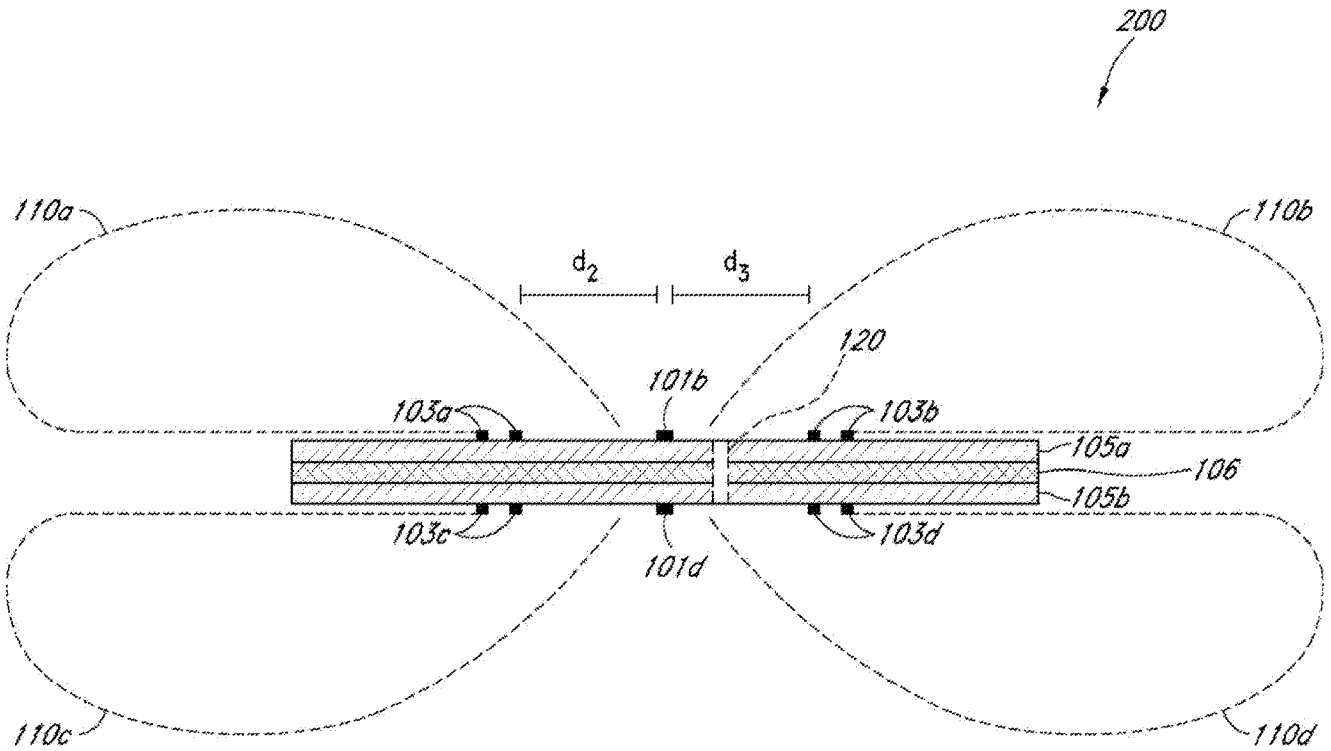
FIG. 2A is a cross-sectional view of an antenna apparatus, according to an embodiment of the invention.
Figure 2B:
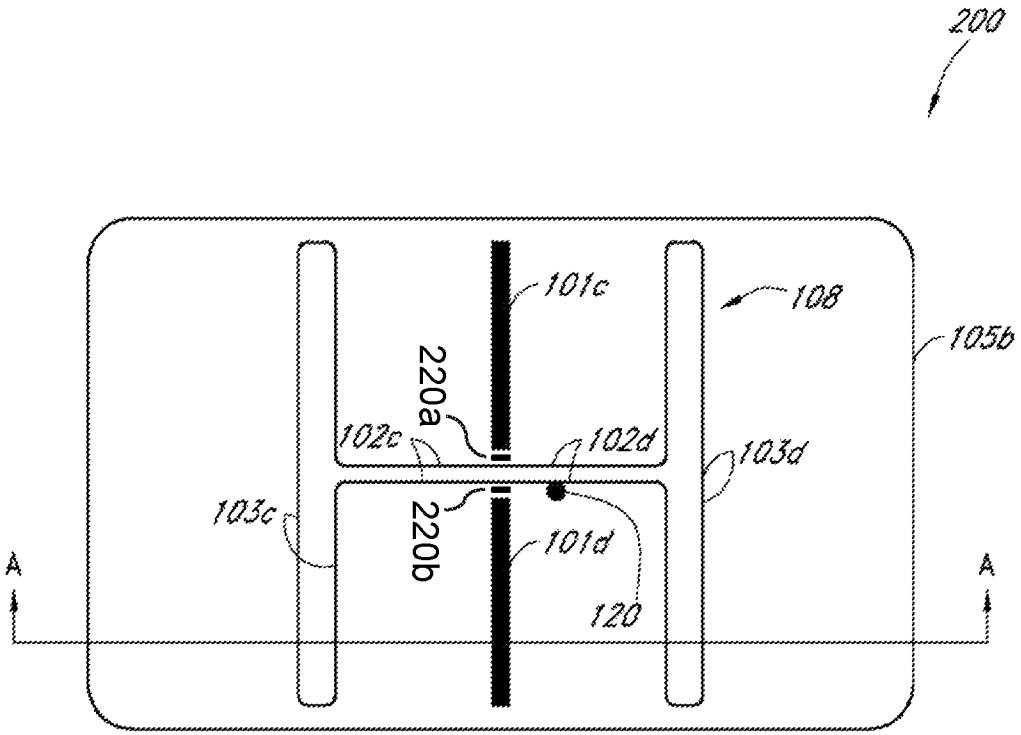
FIG. 2B is a plan view of the antenna apparatus of FIG. 2A, according to an embodiment of the invention.

In a related embodiment, FIGS. 2A and 2B provide views of an antenna apparatus 200. The antenna apparatus 200 illustrated in FIGS. 2A and 2B is similar to and adapted from the antenna apparatus 100 illustrated in FIG. 1A. Accordingly, elements common to both antenna apparatus 100 and 200 share common reference indicia, and only differences between the antenna apparatus 100 and 200 are described herein for the sake of brevity. However, for the sake of facilitating the description only, the dielectric layer 105 shown in FIGS. 1A-1D has been relabeled as the first dielectric layer 105 *a* in FIGS. 2A-2B.

More specifically, FIG. 2A is a cross-sectional view of the antenna apparatus 200, and FIG. 2B is a plan view of the antenna apparatus 200. In addition to the elements illustrated in FIGS. 1A-1B, the antenna apparatus illustrated in FIGS. 2A-2B includes a second dielectric layer 105 *b* on the second face of the electromagnetically reflective layer 106, and an arrangement of conductors on the second dielectric layer 105 *b*. The arrangement of conductors on the second dielectric layer 105 *b* includes a resonator 108 and a reflector comprising first and second portions 101 *c*, 101 *d*.

In some embodiments, the antenna apparatus 200 additionally includes an optional conductive connector 120 extending through the first dielectric layer 105 *a*, the electromagnetically reflective layer 106 and the second dielectric layer 105 *b*. The conductive connector 120 electrically connects the first and second coupling elements. Additionally, a dielectric separator is interposed between the electromagnetically reflective layer 106 and the conductive connector 120 in order to electrically isolate one from the other.

The resonator 108 includes third and fourth antennas 103 *c*, 103 *d* electrically connected by a coupling element. For the sake of facilitating the present description only, the coupling element is labeled as having two portions 102 *c*, 102 *d*. In the antenna apparatus 200 the two portions of the coupling element 102 *c*, 102 *d* are arranged so as to be collinear forming a straight conductive path between the third and fourth antennas 103 *c*, 103 *d*.

The reflector includes first and second portions 101 *c*, 101 *d* separated by a gap through which the coupling element extends and intersects the longitudinal axis of the reflector. In some embodiments, the reflector is a single conductor (not shown), and the antenna apparatus 200 further includes a dielectric separator (not shown) between the reflector and the coupling element. The dielectric separator is provided to electrically isolate the reflector and the coupling element. In other words the dielectric separator prevents the reflector from shorting to the coupling element.

The third and fourth antennas 103*c* 103*d* are folded dipole antennas, and the respective feed point of each of the third and fourth antennas 103 *c*, 103*d* includes respective first and second feed terminals. Accordingly, the two portions of the coupling element 102 *c*, 102 *d* include first and second parallel conductive traces. The first conductive trace electrically connects the respective first feed terminals of the third and fourth antennas 103 *c*, 103 *d*. The second conductive trace electrically connects the respective second feed terminals of the third and fourth antennas 103 *c*, 103 *d*.

Those skilled in the art will recognize from the present disclosure and drawings that the respective arrangements of conductors on the respective first and second dielectric layers 105 *a*, 105 *b* are substantially identical. The resulting radiation pattern for the antenna apparatus 200 is therefore substantially symmetric. In particular, the radiation pattern created by the reflector portions 101 *c*, 101 *d* and the third and fourth antennas 103 *c*,103 *d* being the substantial mirror image of the radiation pattern created by the reflector portions 101 *a*, 101 *b* and the first and second antenna 103 *a*,103 *b*.

I a related embodiment, FIG. 2A shows a cross-sectional view of an approximation of the radiation pattern for the antenna apparatus 200. FIG. 2B shows a plan view of the embodiment shown in FIG. 2A. The reflector portions 101 *a*, 101 *b* distort the toroidal radiation patterns of the first and second folded dipole antennas 103 *a*, 103 *b*. The reflector portions 101 *c*, 101 *d* distort the toroidal radiation patterns of the third and fourth folded dipole antennas 103 *c*, 103 *d*. For the first folded dipole antenna 103 *a*, the result is a radiation pattern approximated by the dashed line 110 *a*. For the second folded dipole antenna 103 *b* the result is a radiation pattern approximated by the dashed line 110 *b*. For the third folded dipole antenna 103 *c*, the result is a radiation pattern approximated by the dashed line 110 *c*. For the fourth folded dipole antenna 103 *d*, the result is a radiation pattern approximated by the dashed line 110 *d*. In operation, RF signals received by one of the antennas are coupled through the coupling element and propagated by through the respective radiation pattern of the other. The conductive connector 120 allows signal energy to be received on one side of the electromagnetically reflective layer 106 and propagated through the radiation patterns of the respective antennas on the other side of the electromagnetically reflective layer 106.

Those skilled in the art will also appreciate from the present disclosure that the respective arrangements of conductors do not have to be substantially identical, and can instead be configured in any number of ways in order to create different radiation patterns for one or more of the first, second, third and fourth antennas.

Figure 3:
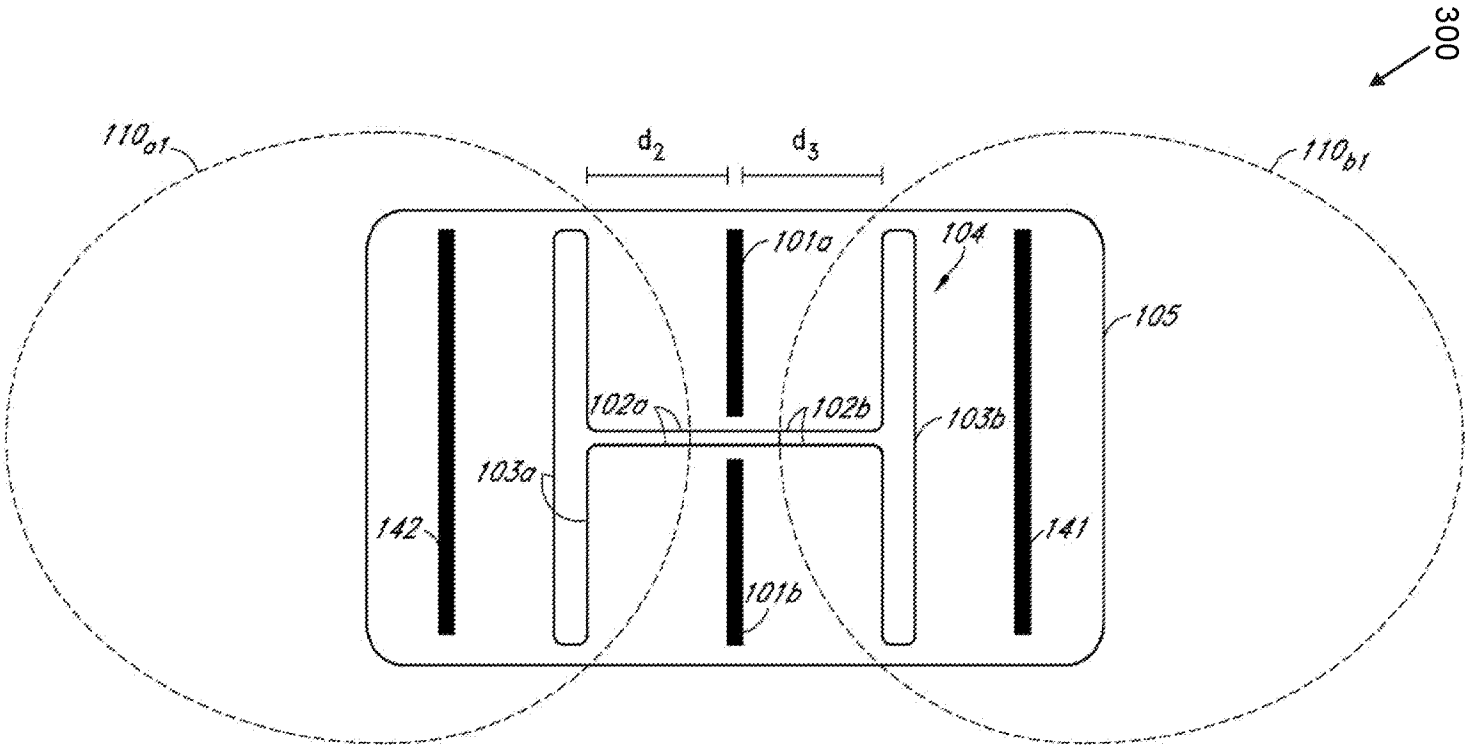
FIG. 3 is a plan view of an antenna apparatus illustrated with an approximation of the radiation pattern of the antenna apparatus, according to an embodiment of the invention.

In a related embodiment, FIG. 3 is a plan view of an antenna apparatus 300 illustrated with an approximation of its radiation pattern. The antenna apparatus 300 illustrated in FIG. 3 is similar to and adapted from the antenna apparatus 100 illustrated in FIG. 1A. Accordingly, elements common to both antenna apparatus 100 and 300 share common reference indicia, and only differences between the antenna apparatus 100 and 300 are described herein for the sake of brevity.

With reference to FIG. 3, the first arrangement of conductors can additionally include first and second director elements 142, 141. The first director 142 can be positioned adjacent the first folded dipole antenna 103 *a*, such that the first folded dipole antenna 103 *a* is between the reflector portions 101 *a*, 101 *b* and the first director 142. The second director 141 can be positioned adjacent the second folded dipole antenna 103 *b*, such that the second folded dipole antenna 103 *b* is between the reflector portions 101 *a*, 101 *b* and the second director 141. While the antenna apparatus 300 can include a director element adjacent to each of the first and second antennas 103 *a*, 103 *b*, in another embodiment an antenna apparatus can include a single director adjacent to one of the first and second antennas. In such an embodiment, the radiation pattern will be different from the approximated radiation pattern illustrated in FIG. 3. In another embodiment, an antenna apparatus can include multiple directors adjacent to one of the first and second antennas.

As compared to the approximated radiation pattern illustrated in FIG. 1C, the first and second directors 142, 141 of FIG. 3 elongate the radiation pattern on either side of the reflector portions 101 *a*, 101 *b*. For the first folded dipole antenna 103 *a*, the result is an elongated radiation pattern approximated by the dashed line 110 $a_1$. For the second folded dipole antenna 103 *b*, the result is an elongated radiation pattern approximated by the dashed line 110$b_1$.

Figure 4:
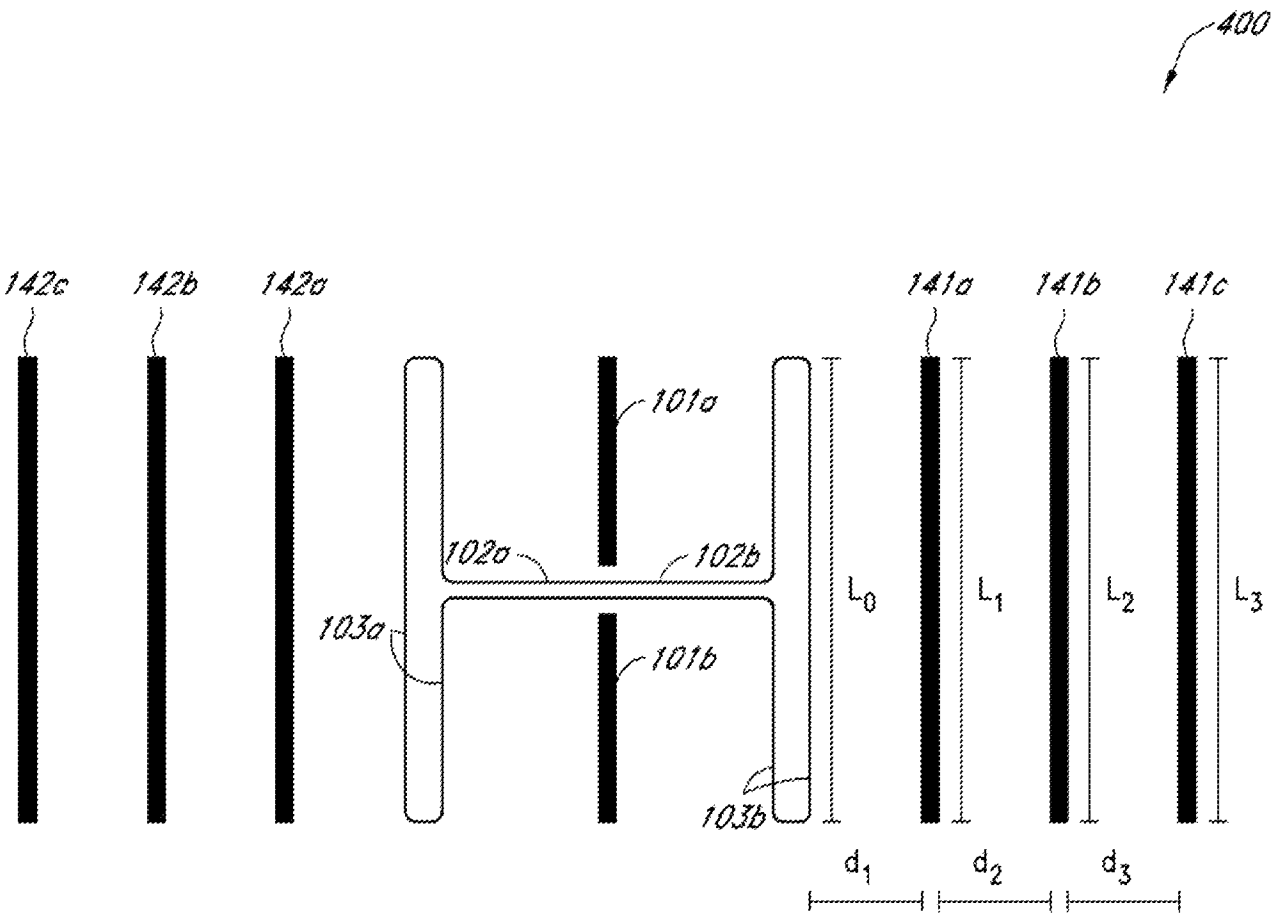
FIG. 4 is a plan view of an antenna apparatus, according to an embodiment of the invention.

In a related embodiment, FIG. 4 shows a plan view of an antenna apparatus 400, in which only the arrangement of conductors disposed on the dielectric layer is shown. The antenna apparatus 400 illustrated in FIG. 4 is similar to and adapted from the antenna apparatus 100 illustrated in FIG. 1A. Accordingly, elements common to both antenna apparatus 100 and 400 share common reference indicia, and only differences between the antenna apparatus 100 and 400 are described herein for the sake of brevity.

With reference to FIG. 4, the arrangement of conductors additionally includes a plurality of directors 142 *a*, 142 *b*, 142 *c* parallel to the reflector portions 101 *a*, 101 *b*, and positioned such that the first folded dipole antenna 103 *a* is between the plurality of directors 142 *a*, 142 *b*, 142 *c* and the reflector portions 101 *a*, 101 *b*. Additionally, the arrangement of conductors additionally includes a plurality of directors 141 *a*, 141 *b*, 141 *c* parallel to the reflector portions 101 *a*, 101 *b*, and positioned such that the second folded dipole antenna 103 *b* is between the plurality of directors 141 *a*, 141 *b*, 141 *c* and the reflector portions 101 *a*, 101 *b*. While only three directors are shown with each antenna in FIG. 4, those skilled in the art will appreciate that an antenna can be provided with any number of directors or even no directors at all. Moreover, each antenna may include more or less directors than other antennas in the same apparatus.

The respective distances between the directors can be varied to change the radiation pattern of the antenna apparatus 400. Examples are described in further detail below with further reference to FIG. 4, in which the distances $d_1$, $d_2$, and $d_3$ correspond to the respective distance between the second folded dipole antenna 103 *b* and the director 141 *a*, the respective distance between the directors 141 *a*, 141 *b*, and the respective distance between the directors 141 *b*, 141 *c*.

The respective lengths of the directors can be varied to change the bandwidth of the antenna apparatus 400. Examples are described in further detail below with further reference to FIG. 4, in which the lengths $L_0$, $L_1$, $L_2$, and $L_3$ correspond to the length of the second folded dipole antenna 103 *b*, the director 141 *a*, the director 141 *b*, and the director 141 *c*, respectively.

In some embodiments, the plurality of directors can be arranged such that the respective distance between adjacent directors decreases between successive pairs of directors, starting from the distance between the first of the plurality of directors immediately adjacent to one of the first and second antennas. For example, with further reference to FIG. 4, when the distances $d_1$, $d_2$, and $d_3$ are such that $d_1 < d_2, < d_3$, the radiation pattern of the second folded dipole antenna 103 *b* bulges outward parallel to the longitudinal axis of the reflector portions 101 *a*, 101 *b*.

In some embodiments, the plurality of directors can be arranged such that the respective distance between adjacent directors increases starting from the distance between the first of the plurality of directors immediately adjacent to one of the first and second antennas. For example, with further reference to FIG. 4, when the distances $d_1$, $d_2$, and $d_3$ are such that $d_1 > d_2, > d_3$, the radiation pattern of the second folded dipole antenna 103 *b* elongates in a manner similar to the radiation pattern 110 $b_1$ illustrated in FIG. 3.

In some embodiments, the plurality of directors can be configured such that the length of a particular director is shorter than the immediately adjacent director starting from the first of the plurality of directors immediately adjacent to one of the first and second antennas. For example, with further reference to FIG. 4, when the lengths $L_1$, $L_2$, and $L_3$ are such that $L_1 < L_2, < L_3$ the radiation pattern of the second folded 103 *b* dipole antenna increases on the higher frequency end of the bandwidth.

In some embodiments, the plurality of directors can be configured such that the length of a particular director is longer than the immediately adjacent director starting from the first of the plurality of directors immediately adjacent to one of the first and second antennas. For example, with further reference to FIG. 4, when the lengths $L_1$, $L_2$, and $L_3$ are such that $L_1 > L_2, > L_3$ the bandwidth of the second folded dipole antenna 103 *b* increases on the lower frequency end of the bandwidth.

Figure 5:
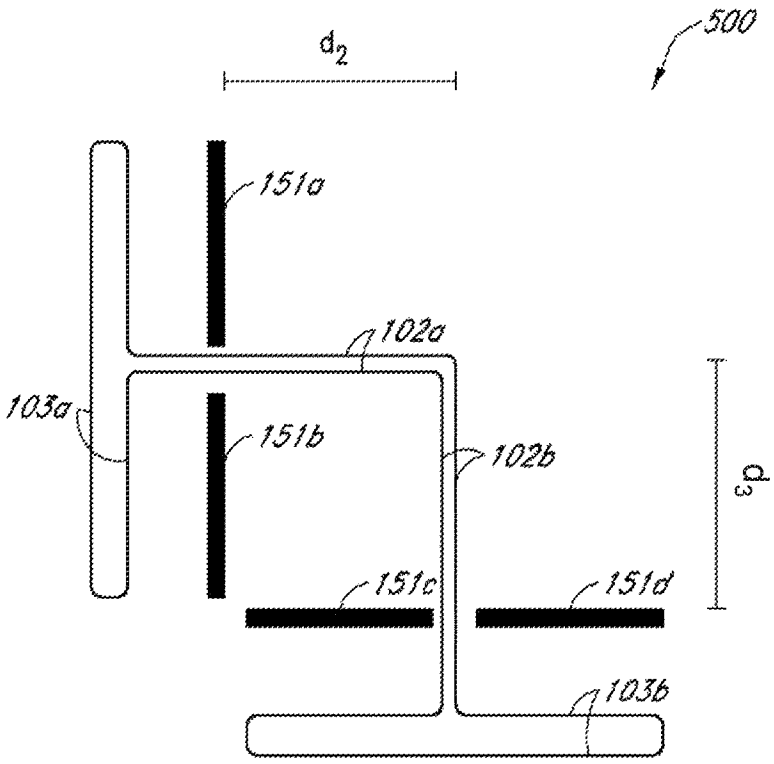
FIG. 5 is a plan view of an antenna apparatus, according to an embodiment of the invention.

In a related embodiment, FIG. 5 shows a plan view of an antenna apparatus 500, in which only the arrangement of conductors disposed on the dielectric layer is shown. The antenna apparatus 500 illustrated in FIG. 5 is similar to and adapted from the antenna apparatus 100 illustrated in FIG. 1A. Accordingly, elements common to both antenna apparatus 100 and 500 share common reference indicia, and only differences between the antenna apparatus 100 and 500 are described herein for the sake of brevity.

In contrast to FIG. 1A, with reference to FIG. 5, the two portions of the coupling element 102 *a*, 102 *b* meet at a corner and the first and second antennas 103 *a*, 103 *b* are arranged facing respective first and second directions. While the two portions of the coupling element 102 *a*, 102 *b* are illustrated as being perpendicular to one another, those skilled in the art will appreciate from the present disclosure that the two portions of the coupling element 102 *a*, 102 *b* can be arranged at any angle in order to customize the radiation pattern of the antenna apparatus.

Additionally, the antenna apparatus 500 includes two reflectors. The first reflector includes portions 151 *a*, 151 *b* separated by a gap through which the first coupling element portion 102 *a* extends and intersects the longitudinal axis of the first reflector. The second reflector includes portions 151 *c*, 151 *d* separated by a gap through which the second coupling element portion 102 *b* extends and intersects the longitudinal axis of the second reflector.

Additionally, the distance between the reflector portions 151 *a*, 151 *b* and the corner is $d_2$, and the distance between the reflector portions 151 *c*, 151 *d* and the corner is $d_3$. The distances $d_2$, $d_3$ can be equal or different.

Figure 6:
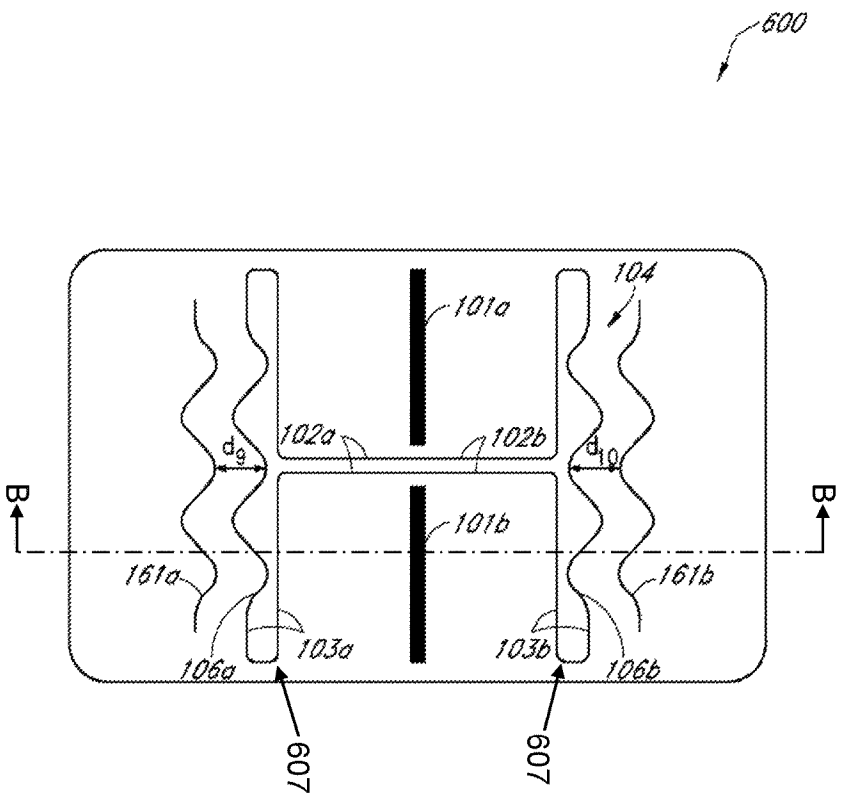
FIG. 6 is a plan view of an antenna apparatus, according to an embodiment of the invention.

In another related embodiment, FIG. 6 shows a plan view of an antenna apparatus 600, in which only the arrangement of conductors disposed on the dielectric layer is shown. The antenna apparatus 600 illustrated in FIG. 6 is similar to and adapted from the antenna apparatus 100 illustrated in FIG. 1A. Accordingly, elements common to both antenna apparatus 100 and 600 share common reference indicia, and only differences between the antenna apparatus 100 and 600 are described herein for the sake of brevity.

With reference to FIG. 6, the first folded dipole antenna 103 *a* can include an undulating portion 106 *a*. The undulating portion 106 *a* is duplicated by the director 161 *a* such that the distance $d_9$ between corresponding points on the undulating portion 106 *a* and the director 161 *a* is substantially constant along the length of each.

Similarly, the second folded dipole antenna 103 *b* can include an undulating portion 106 *b*. The undulating portion 106 *b* is duplicated by the director 161 *b* such that the distance $d_{10}$ between corresponding points on the undulating portion 106 *b* and the director 161 *b* is substantially constant along the length of each.

The undulating portions 106 *a*, 106 *b* allow the antenna apparatus to be scaled down, i.e. made smaller, while substantially preserving the defining wavelengths of the first and second folded dipole antennas 103 *a*, 103 *b*.

While only one director is shown with each antenna in FIG. 6, those skilled in the art will appreciate that an antenna can be provided with any number of directors or even no directors at all. For example, each dipole antenna 103 *a*, 103 *b* shown in FIG. 6 can include two directors. Moreover, each antenna may include more or less directors than other antennas in the same apparatus.

Moreover, in some embodiments, the curvature of the undulations is configured to reduce the concentration of RF energy at inflection points where the metal traces change directions. By contrast, those skilled in the art will appreciate from the present disclosure that sharp corners (e.g. creating a zig-zag) pattern would result in a concentration of RF energy at the corners, which thereby substantially changes the density of RF energy along the length of the first and second antennas and/or the director elements.

Figure 7:
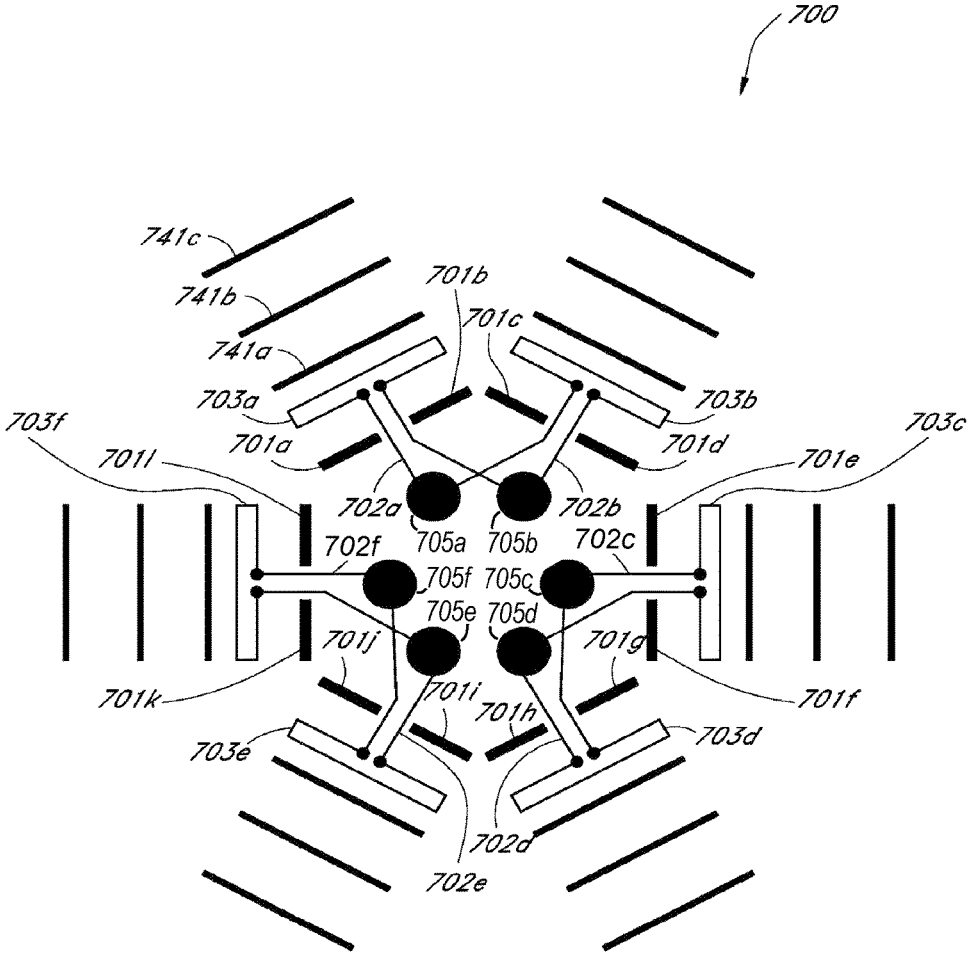
FIG. 7 is a plan view of an antenna apparatus, according to an embodiment of the invention.

In yet another related embodiment, FIG. 7 shows a plan view of an antenna apparatus 700, in which only the arrangement of conductors disposed on the dielectric layer is shown. The arrangement of conductors includes:

a. folded dipole antennas 703 *a*, 703 *b*,703 *c*, 703 *d*, 703 *e*, 703 *f;* b. reflector portions 701 *a*, 701 *b*, 701 *c*, 701 *d*, 701 *e*,701 *f*, 701 *g*, 701 *h*, 701 *i*, 701 *j*, 701 *k*, 701 *l*; and c. conductive traces 702 *a*, 702 *b*, 702 *c*, 702 *d*, 702 *e*, 702 *f.* wherein each folded dipole antenna 703 *a*, 703 *b*, 703 *c*,703 *d*, 703 *e*, 703 *f* is provided with an adjacent plurality of directors. For example, the folded dipole antenna 703 *a* is provided with directors 741 *a*,741 *b*, 741 *b*. While only three directors are shown in FIG. 7, those skilled in the art will appreciate that an antenna can be provided with any number of directors or even no directors at all. Moreover, each antenna may include more or less directors than other antennas in the same apparatus.

The folded dipole antennas 703 *a*, 703 *b*, 703 *c*, 703 *d*, 703 *e*, 703 *f* are arranged in a hexagonal approximation of a circle. Each of the folded dipole antennas 703 *a*, 703 *b*, 703 *c*, 703 *d*, 703 *e*, 703 *f* is paired with one adjacent antenna. Specifically, as shown in FIG. 7, antennas 703 *a* and 703 *b* are paired, antennas 703 *c* and 703 *d* are paired, and antennas 703 *e* and 703 *f* are paired. The result is that the radiation pattern formed by a pair of antennas approximates a bent pipe from one side of the arrangement of antennas to an adjacent side, such that signals received on one side are propagated from the adjacent side.

Conductive traces 702 *a*, 702 *b* electrically connect the respective first and second feed terminals 705 *a*, 705 *b* of the antennas 703 *a*, 703 *b*. Conductive traces 702 *c*,702 *d* electrically connect the respective first and second feed terminals 705 *c*, 705 *d* of the antennas 703 *c*, 703 *d*. Conductive traces 702 *e*, 702 *f* electrically connect the respective first and second feed terminals 705 *e*, 705 *f* of the antennas 703*e*, 703 *f*.

The conductive traces 702 *a*, 702 *b* extend through a gap separating reflector portions 701 *a*, 701 *b*. The conductive traces 702 *a*, 702 *b* also extend through a gap separating reflector portions 701 *c*, 701 *d*. The conductive traces 702 *c*, 702 *d* extend through a gap separating reflector portions 701 *e*, 701 *f*. The conductive traces 702 *c*, 702 *d* also extend through a gap separating reflector portions 701 *g*, 701 *h*. The conductive traces 702 *e*, 702 *f* extend through a gap separating reflector portions 701 *i*, 701 *j*. The conductive traces 702 *e*, 702 *f* also extend through a gap separating reflector portions 701 *k*, 701 *l*.

Figure 8:
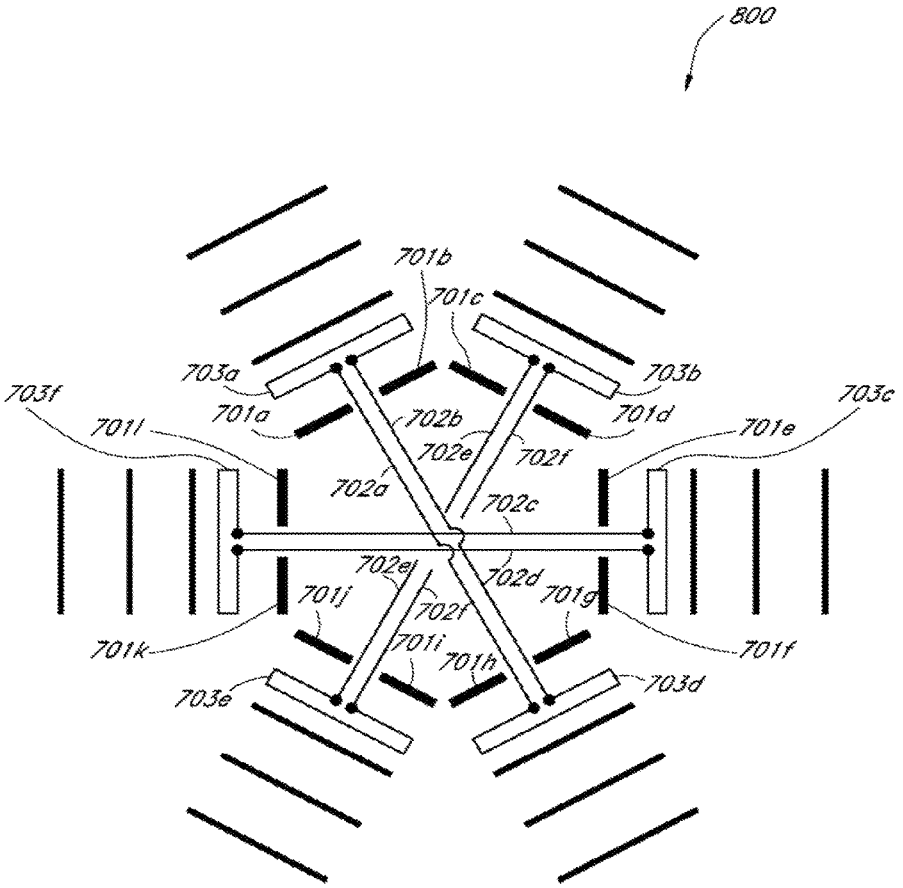
FIG. 8 is a plan view of an antenna apparatus, according to an embodiment of the invention.

In yet another related embodiment, FIG. 8 shows a plan view of an antenna apparatus 800, in which only the arrangement of conductors disposed on the dielectric layer is shown. The antenna apparatus 800 illustrated in FIG. 8 is similar to and adapted from the antenna apparatus 700 illustrated in FIG. 7. Accordingly, elements common to both antenna apparatus 700 and 800 share common reference indicia, and only differences between the antenna apparatus 700 and 800 are described herein for the sake of brevity.

As compared to the antenna apparatus 700, each of the folded dipole antennas 703 *a*, 703 *b*, 703 *c*, 703 *d*, 703 *e*, 703 *f* is respectively electrically paired and connected to the corresponding folded dipole antenna diametrically opposite a particular one of the folded dipole antennas. Specifically, antennas 703 *a* and 703 *d* are electrically coupled by parallel conductive traces 702 *a*, 702 *b*, antennas 703 *b* and 703 *e* are electrically coupled by parallel conductive traces 702 *e*, 702 *f*, and antennas 703 *c* and 703 *f* are electrically coupled by parallel conductive traces 702 *c*, 702 *d*. The conductive traces 702 *e*, 702 *f* electrically coupled to antennas 703 *b*, 703 *e* are partially hidden to simplify the view in FIG. 8; those traces 702 *e*, 702 *f* are configured to electrically couple the antennas 703 *b*, 703 *e* despite a portion of the traces 702 *e*, 702 *f* not being shown. The result is that the radiation pattern formed by a pair of antennas approximately extends from one side of the arrangement of antennas through to a diametrically opposite side, such that signals received on one side are propagated from the diametrically opposite side.

Additionally, and/or alternatively, an embodiment of antenna apparatus can be combined with a user interface. The user interface may include a detector circuit and a user-readable display, such as a series of diodes or a liquid crystal display. In some embodiments, the detector circuit is coupled between the resonant structure of an antenna apparatus and the user interface. The detector circuit can be configured to draw off a small portion of RF signal energy received by one or more of the antennas in operation. The detector can provide a signal to the user interface according to how much RF signal energy is detected. For example, the detector can be configured to detect RF signal energy in relation to two or more threshold levels. If RF signal energy is lower than a first threshold level, the detector signals that the RF signal energy is very weak or non-existent. If RF signal energy is between the first and second threshold levels, the detector signals that the RF signal energy is low. If RF signal energy is higher than the second threshold level, the detector signals that the RF signal energy is strong. In response to receiving the detector signal, the user interface provides a corresponding user readable output that can be interpreted by a user. The user readable output can include one or more visual indicators, displays, lamps, other output devices, or a combination of devices. In some embodiments, the user interface and/or the detector circuit can be disposed in a single housing that also contains the antenna apparatus.

Some embodiments provide a small sized antenna apparatus that acts as a passive repeater that is sewn into a denim cloth enclosure. The antenna apparatus can be designed to facilitate signal gain for a collection or range of frequencies. Some embodiments are configured to be used with mobile phone networks (for example, networks operating at 750 MHz to 1.920 GHz or other frequencies), wireless data networks (for example, Wi-Fi networks operating at 2.4 to 5.8 GHz or other frequencies), other frequencies, or combinations of frequencies. In some embodiments, the antenna apparatus is placed within 6-24 inches of a device with a wireless receiver and/or transmitter, where the antenna apparatus causes increased signal intensity at the device. Certain embodiments produce gain to signals propagating at existing ambient radio frequencies. The higher gain signal can propagate to a local receiver or from a local transmitter to a remote receiver.

Certain embodiments provide an antenna apparatus including a RF reflective ground plane and a second insulating layer composed of a non-conductive cloth or similar material. A conductive thread is then sewn on a third layer of cloth in a specific design. The first and third layers can be configured to substantially transmit electromagnetic radiation in a spectral region of interest. The apparatus can include a plurality of conductive thread traces sewn on an outward-facing surface of the third layer. The apparatus can include the second layer insulating cloth. The apparatus can include a layer of shielding cloth that acts as a ground plane. The plurality of conductive thread traces can be configured to act as a passive repeater for electromagnetic radiation in the spectral region of interest. The entire element is sewn into a protective cloth cover.

The flexible fabric passive repeater is sewn or mounted onto or into the desired piece of clothing to assist higher gain radio frequency signals by proximity to the desired Wi-Fi or cell phone appliance to enable greater range to the desired initial emitter thereby to communicate at a greater distance than without the flexible fabric passive repeater.

Figure 9A:
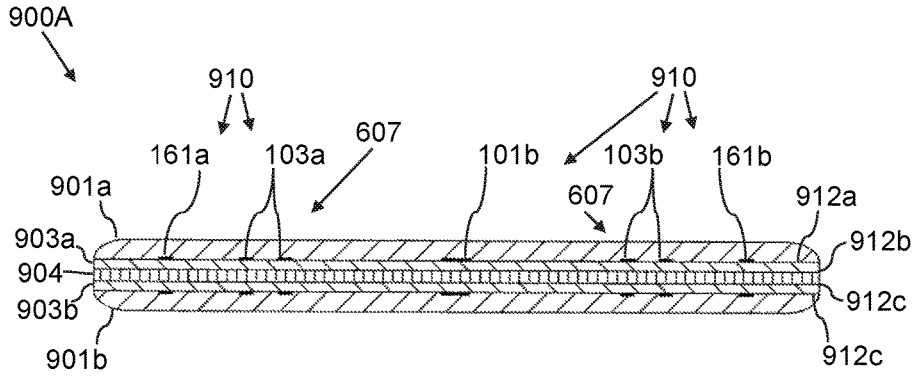
FIG. 9A is a cross-sectional view of an antenna apparatus, according to an embodiment of the invention.

In an embodiment, as shown in FIG. 9A, an antenna apparatus 900A can have a layered cross-sectional design including:

a. protective first and second cover layer 901 *a*, 901 *b;*
b. first and second insulation layers 903 *a*, 903 *b*; and
c. a conductive layer 904 also referred to as a ground plane 904, or an electromagnetic reflective layer 904; such that the layered cross sectional design can support a plurality of different antenna layouts on the outer surfaces of first and second insulation layers 903 *a*, 903 *b*, including antenna layouts as shown in FIGS. 1A, 1C, 2B, 3, 4, 5, 6, 7, and 8.

In a related embodiment, the first cover layer 901*a*, the first insulation layer 903*a*, the conductive layer 904, the second insulation layer 903*b*, and the second cover layer 901*b*, can be sandwiched together with adhesive layers 912 *a*, 912 *b*, 912 *c*, 912 *d*.

in a related embodiment, as further shown in FIG. 9A, the antenna apparatus 900A can be configured with an antenna layout as shown in FIG. 6, shown in FIG. 9A as a cross-sectional view of the antenna apparatus along line B-B of FIG. 6, wherein the antenna layout is formed by conductive traces 910, including:

a. director elements 161 *a*, 161 *b;*
b. a resonator 607; and
c. a reflector 101 *b;*
wherein the conductive traces 910 are configured to operate as a passive repeater.

In a related embodiment, the antenna apparatus can include a plurality of conductive traces 910, in the form of conductive threads, which are sewn near a ground plane 904.

In a related embodiment, the ground plane 904 can be constructed from a highly conductive cloth or fabric material that concentrates signal density in a small area.

In a related embodiment, the director elements 161 *a*, 161 *b* can focus signals propagating at frequencies that are resonant, such as, for example, signals where the half wavelength is equal to the length of the director elements 161 *a*, 161 *b*.

In a related embodiment, the antennas 103 *a*, 103 *b* of the resonator 607 can radiate radio frequency energy that is resonant to a one-half wavelength. The reflector 101 *b* can reflect a signal back toward the resonator 607 and the director elements 161 *a*, 161 *b*, thereby increasing the signal intensity.

In a related embodiment, the director elements 161 *a*, 161 *b*, the reflector 101 *b*, and the resonator 607 can be sewn traces of highly conductive thread, sewn on a fabric, such as a denim cloth. The conductive thread design that form the director elements 161 *a*, 161 *b*, and the resonator 607 can be radiused to avoid or reduce concentration nodes of radio frequency energy. Reduction of concentration nodes can increase signal gain.

In a plurality of embodiments, various flexible materials can be used to construct the antenna apparatus 900A. For example:

a. the protective covers 901 *a*, 901 *b* and insulating layers 903 *a*, 903 *b* can be made from non-conductive flexible materials, including non-conductive fabrics, such as denim;
b. the ground plane 904 can be constructed from a conductive flexible material, including a conductive fabric material, such as Soft & Safe™ shielding fabric, model no. ONA275, manufactured by Less EMF Inc.

In a related embodiment, the ground plane 904 can be made from a shielding fabric, which is washable, has high conductivity (for example with <1 Ohm per sq. inch resistance), and offers exceptionally high RF shielding performance, such that it is well suited for establishing a ground connection. Soft & Safe, as an example, is made with a unique blend of natural materials, including 70% bamboo fiber and 30% Silver, provides greater than 50 dB signal attenuation, and cuts and sews like an ordinary cotton fabric. Soft & Safe can be used in a 135 g/m2 rating. The silver in addition to conductivity, also provides antibacterial and anti-odor functions.

In a related embodiment, a sewing procedure for manufacture of the antenna apparatus 900A can include sewing conductive thread onto an outer or first face of the denim cloth insulation layer 903 *a*, 903 *b*, such that the conductive thread does not penetrate through the insulation layer 903 *a*, 903 *b*.

In a related embodiment, the conductive thread can be sewn at a rate of 92 stitches per inch, using a Happy Single Head 12 color embroidery machine, mounted with 70/10 type needle.

In a related embodiment, the conductive traces that form the director elements 161 *a*, 161 *b*, the reflector 101 *b*, and the resonator 607 can for example be constructed from conductive thread 234/34, 4 ply, part number DEV-08549, manufactured by Sparkfun Electronics, with a resistance of approximately 14 ohms per foot, with a weight approximately one ounce per 2700 lineal inches.

In some embodiments, the antenna apparatus can be carried on a person to add gain to radio frequency signals that are used by devices that use wireless networks. For example, the antenna apparatus can be configured for use with devices in the 1.7-1.9 GHz, 2.4 GHz and/or 5.8 GHz frequency ranges. The antenna apparatus can be configured for use with other frequencies, as well. The antenna apparatus can include an antenna and a conductive plate with an insulating layer formed therebetween. Portions of the antenna can be made with a highly conductive thread that is sewn on the surface of a non-conductive and radio frequency transparent medium. The conductive fabric 904 can act as a radio frequency concentrator, and the conductive thread can act as a passive repeater that is frequency specific, thereby providing gain at selected frequencies.

Figure 9B:
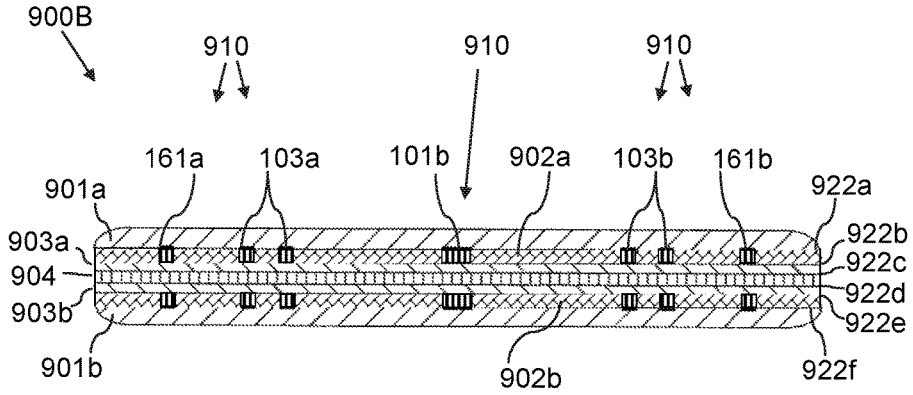
FIG. 9B is a cross-sectional view of an antenna apparatus, according to an embodiment of the invention.

In a related embodiment, as shown in FIG. 9B, the conductive thread can be sewn onto a first or second antenna layer 902 *a*, 902 *b*, formed of a non-conductive and radio frequency transparent medium, which can be a flexible material, such as a fabric material, or a flexible or semi-rigid fabric mesh material, such that the first or second antenna layer 903 *a*, 903 *b* is disposed on a first face of the insulation layer 903 *a*, 903 *b*, sandwiched between the insulation layer 903 *a*, 903 *b* and the protective cover layer 901 *a*, 901 *b*.

In the following, we describe the structure of an embodiment of a passive repeater clothing item 1000 with reference to FIG. 10, in such manner that like reference numerals refer to like components throughout; a convention that we shall employ for the remainder of this specification.

Figure 10:
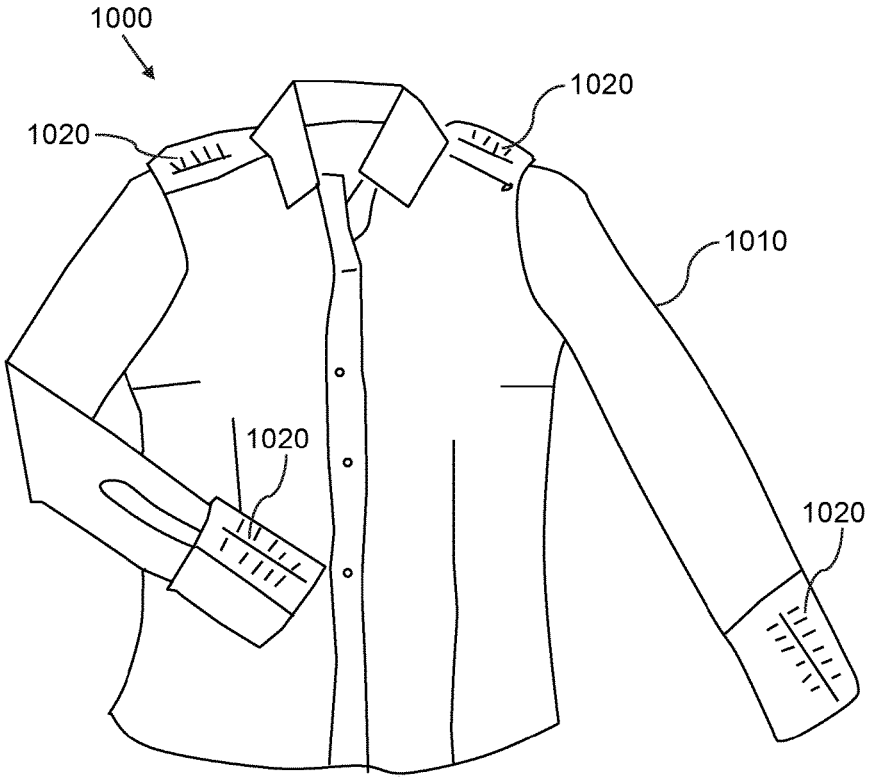
FIG. 10 is a front view of a flexible fabric passive repeater embedded in a long sleeve shirt, according to an embodiment of the invention.

In an embodiment, as shown in FIG. 10, a passive repeater garment 1000 can include:

a. a clothing item 1010, which is configured to be worn on the body of a human;

b. at least one flexible passive repeater 1020;

wherein the at least one passive repeater 1020 is mounted to the clothing item 1010, such that the at least one passive repeater 1020, can alternatively be mounted inside the clothing item 1010, between layers of the clothing item 1010; on an outer surface of the clothing item 1010; or on an inner surface of the clothing item 1010; such that in each mounting alternative the passive repeater 1020 is mounted by sowing, gluing, or an attachment mechanism, such as snap buttons or hook and loop fastener.

In a related embodiment, FIG. 10 shows a front view of a passive repeater garment 1000, wherein the clothing item 1010 is a long sleeve shirt 1010 or jacket 1010, such that the flexible passive repeater 1020 is mounted into the long sleeve shirt 1010. The flexible passive repeater 1020 is located in the cuffs and the shoulders of the clothing item 1010 such that proximity is reduced to be within six inches and the elements are in a vertical direction. When the device is held up to the ear, the shoulder antenna will increase available signal. Typical gain will be in the five to nine dB depending on the distance between the antenna and the device.

Figure 11:
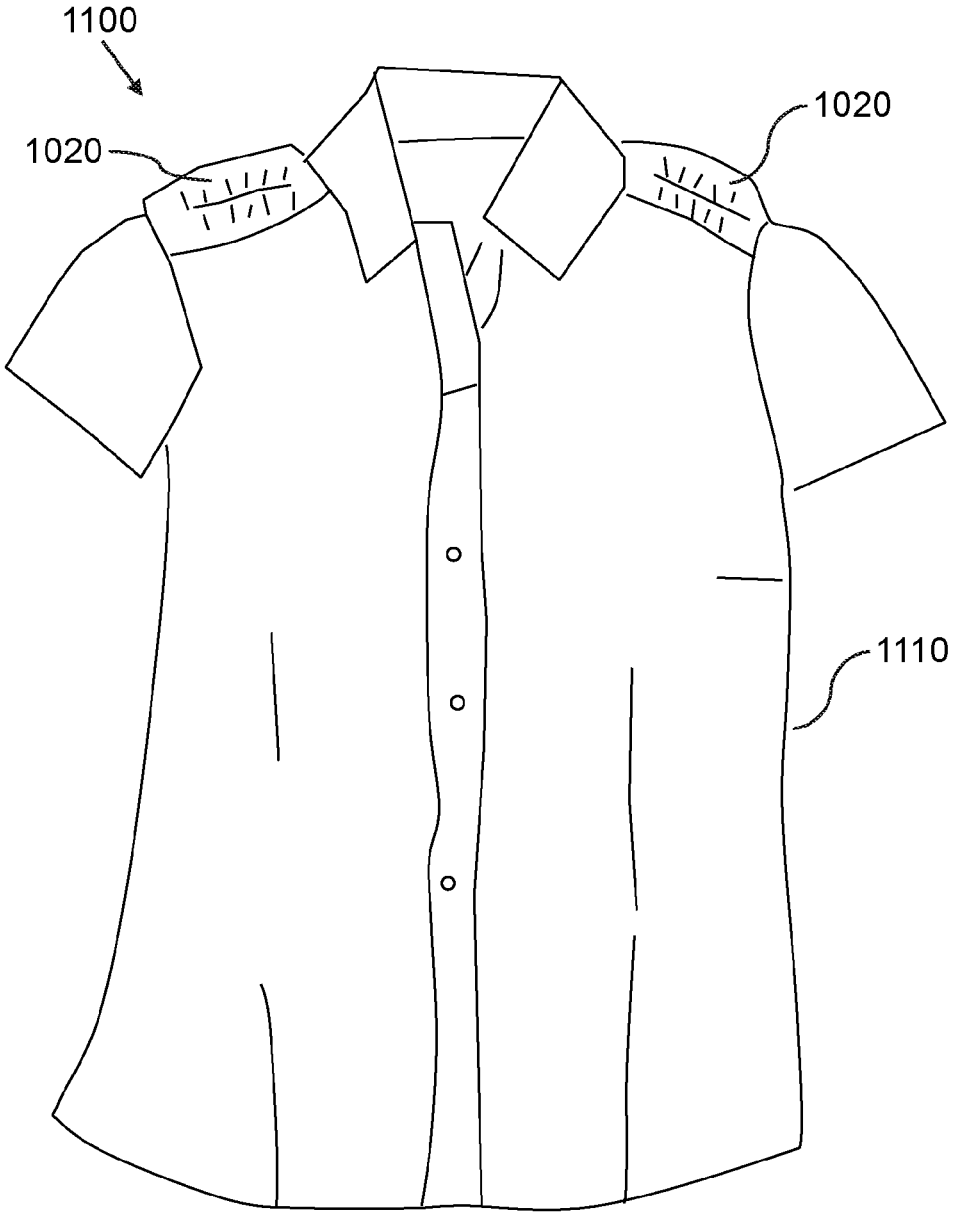
FIG. 11 is a front view of a flexible fabric passive repeater embedded in a short sleeve shirt, according to an embodiment of the invention.

In a related embodiment, FIG. 11 shows a front view of a passive repeater garment 1100, wherein the clothing item 1110 is a short sleeve shirt 1110. The flexible passive repeater 1020 is located in the shoulders of the garment such that proximity is reduced to be within six inches and the elements are in a vertical direction. When the device is held up to the ear, the shoulder antenna will increase available signal. Typical gain will be in the five to nine dB depending on the distance between the antenna and the device.

Figure 12:
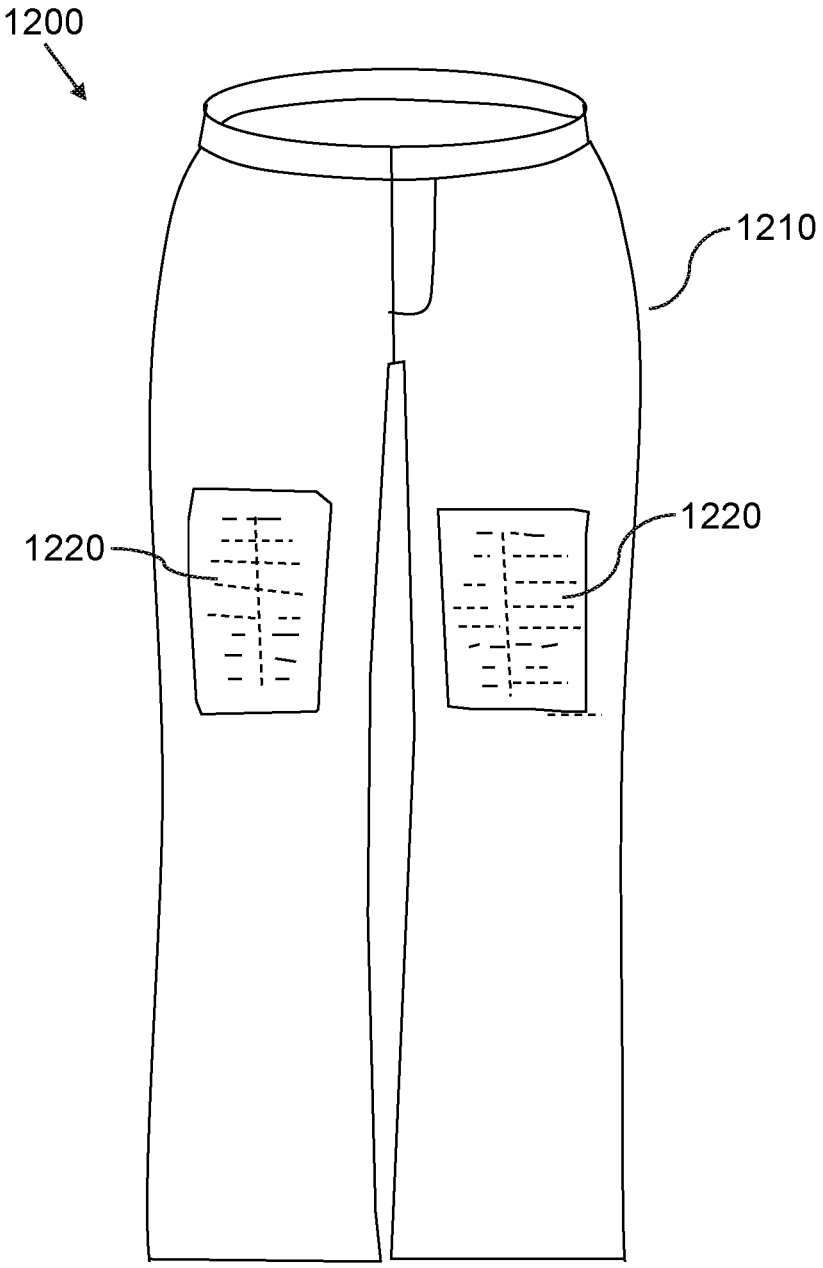
FIG. 12 is a front view of a flexible fabric passive repeater embedded in a pair of pants, according to an embodiment of the invention.

In a related embodiment, FIG. 12 shows a front view of a passive repeater garment 1200, wherein the clothing item 1210 is a pair of pants. Because of the larger area available, a more effective and therefore higher gain flexible passive repeater 1220 may be used. This also allows for different types of antenna designs to be used, such as a Log Periodic type. The antenna will have a wider band width and therefore a wider frequency range will be available. This allows for a greater distance from the phone, tablet or other device. Typical gain will be in the five to nine dB depending on the distance between the antenna and the device.

Figure 13:
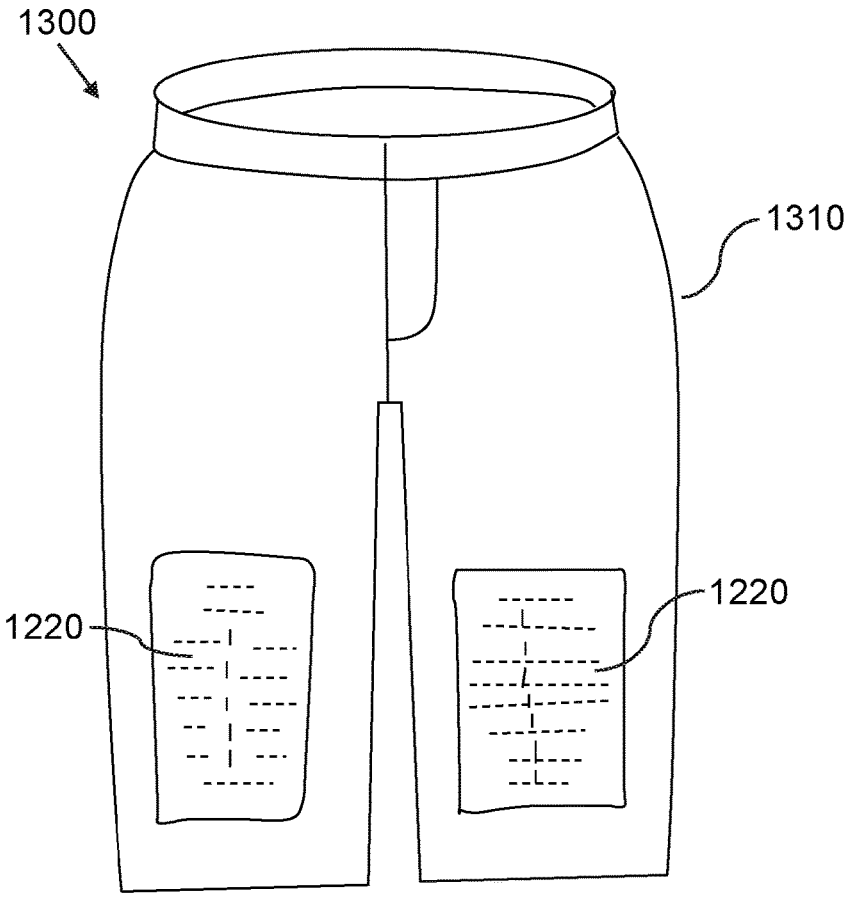
FIG. 13 is a front view of a flexible fabric passive repeater embedded in a pair of shorts, according to an embodiment of the invention.

In a related embodiment, FIG. 13 shows a front view of a passive repeater garment 1300, wherein the clothing item 1310 is a pair of shorts. Because of the larger area available a more effective and therefore higher gain flexible passive repeater 1220 may be used. This also allows for different types of antenna designs to be used, such as a Log Periodic type. The antenna will have a wider band width and therefore a wider frequency range will be available. This allows for a greater distance from the phone, tablet or other device. Typical gain will be in the five to nine dB depending on the distance between the antenna and the device.

Figure 14:
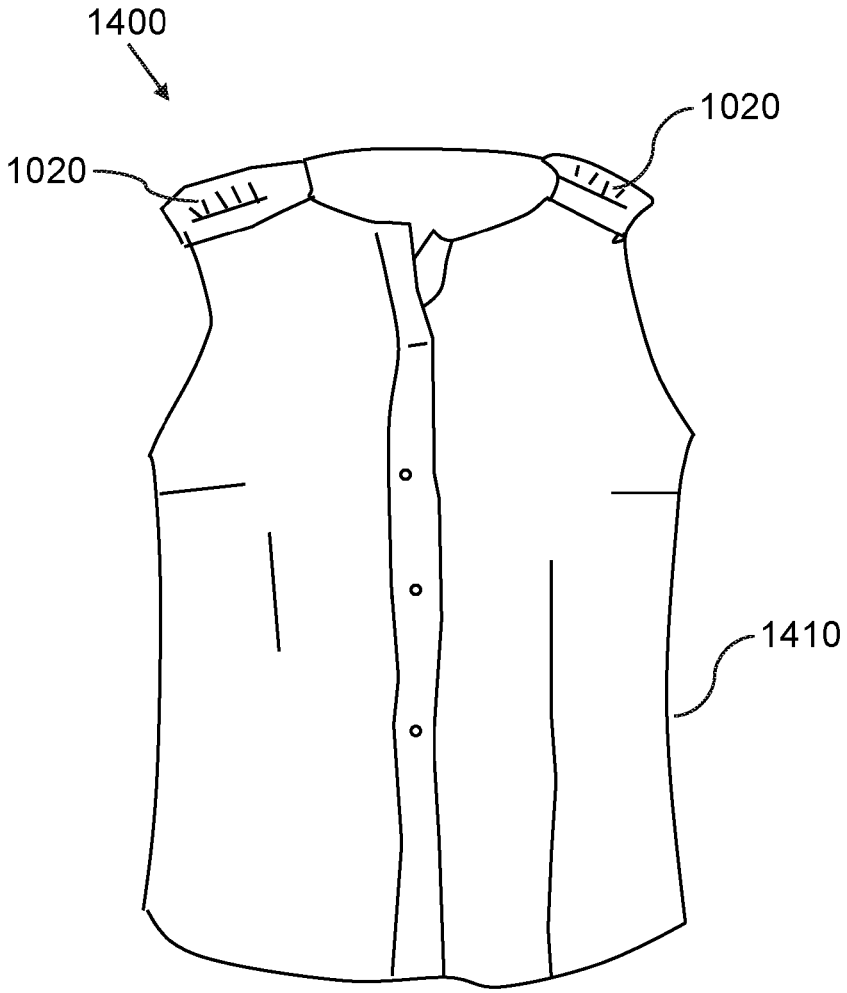
FIG. 14 is a front view of a flexible fabric passive repeater embedded in a vest, according to an embodiment of the invention.

In a related embodiment, FIG. 14 shows a front view of a passive repeater garment 1400, wherein the clothing item 1410 is a vest.

Figure 15A:
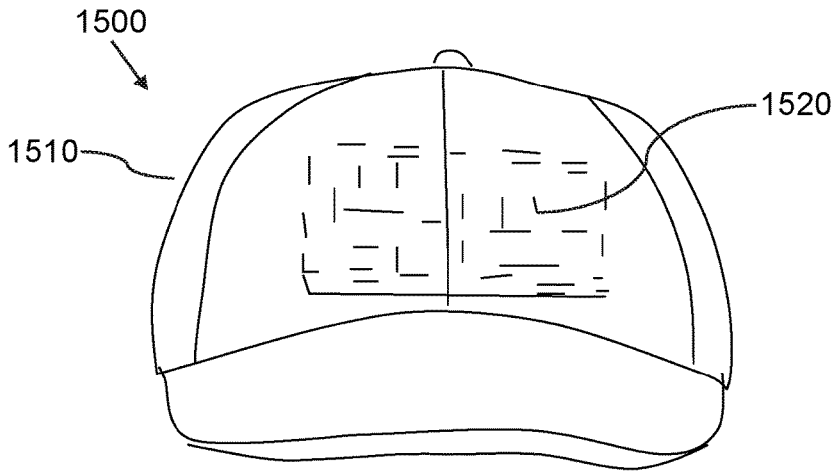
FIG. 15A is a front view of a flexible fabric passive repeater embedded in a baseball cap, according to an embodiment of the invention.
Figure 15B:
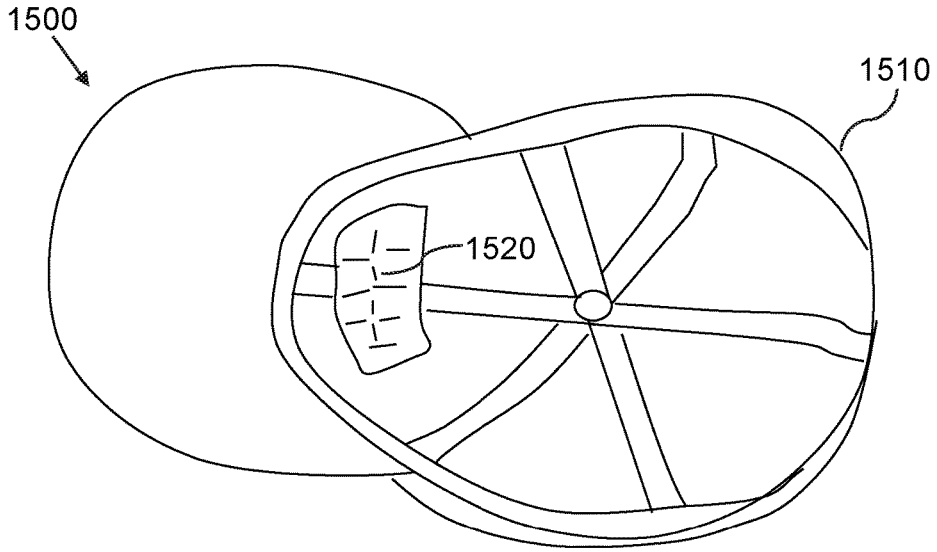
FIG. 15B is a bottom view of a flexible fabric passive repeater embedded in a baseball cap, according to an embodiment of the invention.

In a related embodiment, FIG. 15A shows a front view of a passive repeater garment 1500, wherein the clothing item 1510 is a baseball cap. The flexible passive repeater 1520 is located in the brim of the garment such that proximity is reduced to be within six inches and the elements are in a vertical direction. Typical gain will be in the five to nine dB depending on the distance between the antenna and the device. FIG. 15B shows an inside/bottom view of the passive repeater garment 1500.

Figure 16:
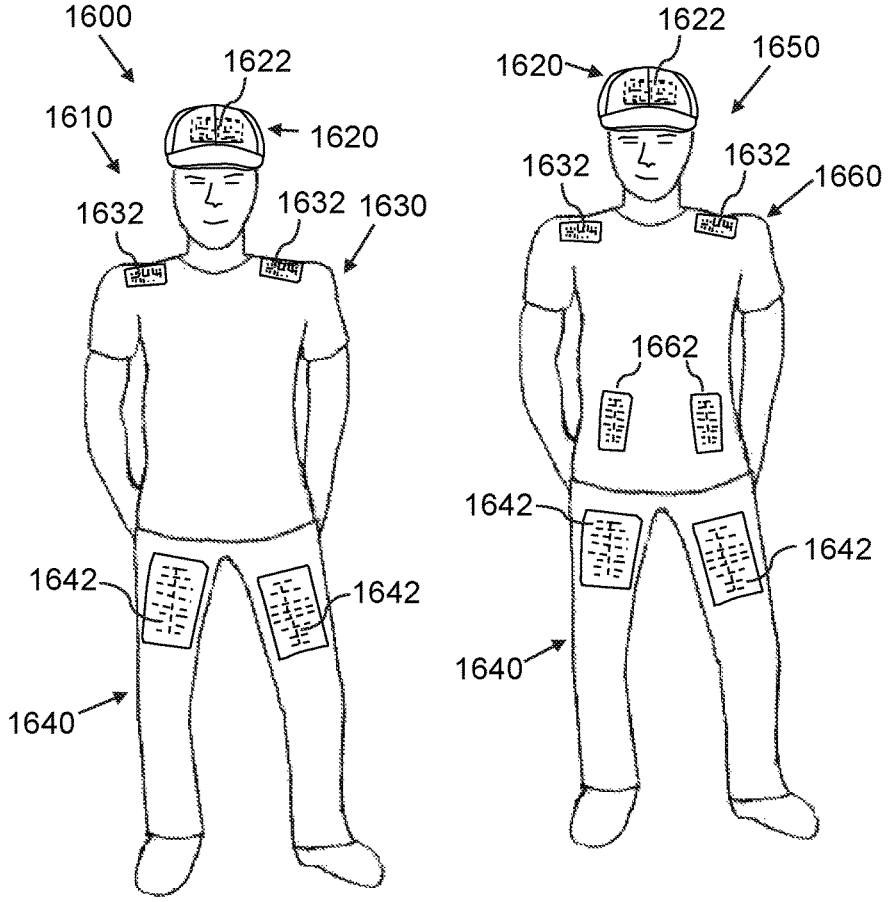
FIG. 16 is a schematic diagram illustrating a system of passive receiver garments, according to an embodiment of the invention.

In an embodiment, as shown in FIG. 16, a system of passive repeater garments 1600 can include:

a) at least one or a plurality of personal assemblies of passive repeater garments 1610 1650, wherein a personal assembly 1610 1650 includes:

i. at least one or a plurality of passive repeater garments 1620 1630 1640 1660, each passive repeater garment 1620 1630 1640 1660 including a plurality of flexible passive repeaters 1622 1632 1642 1662.

In a related embodiment, such a system of passive repeater garments 1600 can be configured for use by an individual or a group of users, such as hunters, outdoors people, law enforcement or military personnel, scientific explorers, or other teams of humans, such that the users may experience improved connectivity for use of wireless devices and other radio communication needs.

Figure 17:
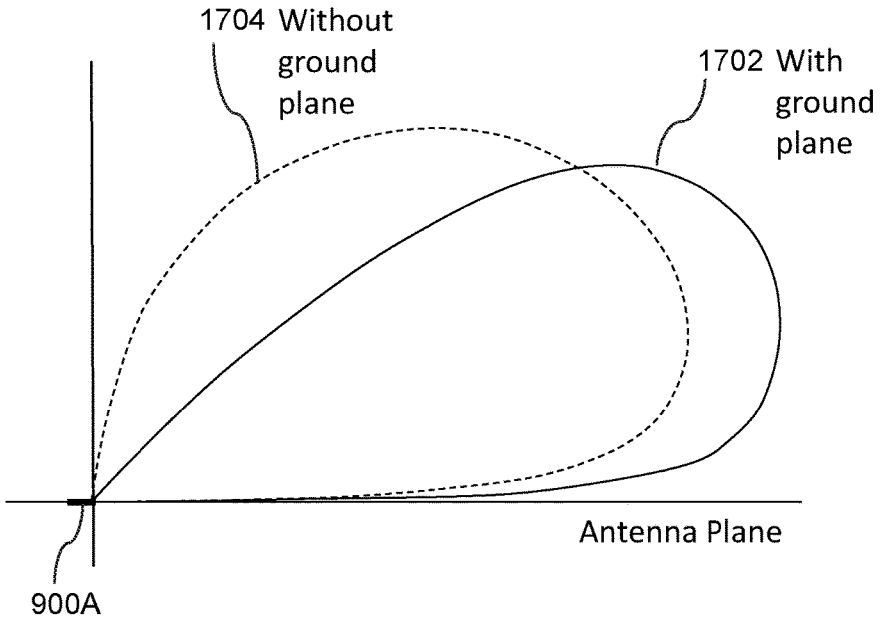
FIG. 17 illustrates a graph of signal propagation from a flexible fabric passive repeater with and without an integral ground plane, according to an embodiment of the invention.

In a related embodiment, FIG. 17 illustrates graphs of signal propagation from an upper part of an antenna apparatus 900A with 1702 and without 1704 *a* ground plane 904. The graph 1704 illustrates the signal propagation from the antenna apparatus 900A without the ground plane. The graph 1702 illustrates the signal propagation from the antenna apparatus with a ground plane. As can be seen from the graph 1702, the ground plane 904 causes the signal to meander further along the plane of the antenna in a greater range compared to the antenna apparatus 900A without the ground plane. Thus, the antenna radiation field is extended in the same plane as the antenna, which means that the range of the RF signals will be extended. Without the ground plane, or electromagnetically reflective layer, in a standard antenna configuration, there is no flattening distortion of the signal and therefore the range is not as extensive. A similar range extending effect is provided by the ground plane in flexible repeater antennas 100 200 300 400 500 600 700 800.

In a further related embodiment, a reduced distance from the antenna layer (formed by conductive traces 910) to the ground plane 904 causes a reduction in input impedance of the passive repeater, which causes the antenna gain to be increased. Correspondingly, the antenna gain is reduced as distance from the antenna layer to the ground plane is increased. The distance can be adjusted by adjusting a thickness of the insulation layer 903 *a*.

Here has thus been described a multitude of embodiments of the passive repeater garment 1000 1100 1200 1300 1400 1500, devices, methods, and systems 1600 related thereto, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A passive repeater garment, comprising:

a) a clothing item, which is configured to be worn on the body of a human; and b) at least one antenna apparatus, comprising:

i. an electromagnetically reflective layer, the electromagnetically reflective layer having first and second faces;

ii. a first insulation layer disposed on the first face of the electromagnetically reflective layer; and iii. a first arrangement of conductors disposed on the first insulation layer, the first arrangement of conductors comprising:

a first resonator, comprising:

a first antenna having a respective feed point, a second antenna having a respective feed point, and a first coupling element electrically connecting the respective feed points of the first and second antennas; and a first reflector, which is electrically isolated from the first resonator and positioned adjacent to at least one of the first and second antennas, and wherein a longitudinal axis of the first reflector intersects the first coupling element;

wherein the at least one antenna apparatus is mounted to the clothing item;

such that the at least one antenna apparatus is configured as a passive repeater.

2. The passive repeater garment of claim 1, wherein the first insulation layer is dielectric.

3. The passive repeater garment of claim 1, wherein the clothing item is a jacket and the at least one antenna apparatus comprises four antenna apparatuses, mounted to the cuffs and shoulders of the jacket.

4. The passive repeater garment of claim 1, wherein the at least one antenna apparatus further comprises a first protective cover layer, which is disposed on a first face of the first insulation layer, such that the first arrangement of conductors is disposed between the first insulation layer and the first protective cover layer, wherein the first protective cover layer is non-conductive.

5. The passive repeater garment of claim 4, wherein the first protective cover layer is flexible.

6. The passive repeater garment of claim 4, wherein the first protective cover layer is made from a non-conductive fabric.

7. The passive repeater garment of claim 6, wherein the first protective cover layer is made from denim.

8. The passive repeater garment of claim 1, wherein the first insulation layer is made from a non-conductive fabric.

9. The passive repeater garment of claim 8, wherein the first insulation layer is made from denim.

10. The passive repeater garment of claim 1, wherein the electromagnetically reflective layer and the first insulation layer are flexible.

11. The passive repeater garment of claim 1, wherein the first arrangement of conductors is made from conductive threads.

12. The passive repeater garment of claim 11, further comprising:

a first antenna layer;

wherein the first antenna layer is non-conductive and flexible, such that the first antenna layer is disposed on a first face of the first insulation layer, wherein the conductive threads are sewn onto the first antenna layer.

13. The passive repeater garment of claim 1, wherein the first reflector comprises first and second conductive portions separated by a gap through which the first coupling element extends and intersects the longitudinal axis of the reflector.

14. The passive repeater garment of claim 1, wherein the first reflector comprises a single conductor, and the antenna apparatus further comprises a dielectric separator interposed between the first reflector and the first coupling element.

15. The passive repeater garment of claim 1, wherein at least one of the first and second antennas is selected from the group consisting of a dipole antenna, a rhombic antenna, a planar antenna, and a Yagi-Uda antenna.

16. The passive repeater garment of claim 1, wherein the first and second antennas are folded dipole antennas, and the respective feed point for each of the first and second antennas comprises first and second feed terminals, and wherein the coupling element includes first and second conductive traces, the first conductive trace electrically connecting the respective first feed terminals of the first and second antennas, and the second conductive trace electrically connecting the respective second feed terminals of the first and second antennas.

17. The passive repeater garment of claim 16, wherein at least one of the first and second antennas includes an undulating portion.

18. The passive repeater garment of claim 16, wherein the first arrangement of conductors further comprises:

a) a second reflector electrically isolated from the first resonator and positioned adjacent to the second antenna;

wherein the longitudinal axis of the second reflector intersects the first coupling element, and wherein the first reflector is positioned adjacent to the first antenna.

19. The passive repeater garment of claim 18, wherein the first coupling element is straight and the first and second antennas are arranged so that the respective radiation pattern of one extends in the substantially opposite direction of the other.

20. The passive repeater garment of claim 18, wherein the first coupling element includes a corner and the first and second antennas are arranged facing respective first and second directions.

21. The passive repeater garment of claim 18, wherein the first arrangement of conductors further comprises at least one director in parallel with at least one of the first and second reflectors, and wherein a respective one of the first and second antennas is positioned between the at least one director and respective one of the first and second reflectors.

22. The passive repeater garment of claim 16, wherein the first arrangement of conductors further comprises at least one director in parallel with the first reflector, and wherein one of the first and second antennas is positioned between the at least one director and the first reflector.

23. The passive repeater garment of claim 16, wherein the first arrangement of conductors further comprises a plurality of directors parallel to the first reflector, and wherein one of the first and second antennas is positioned between the plurality of directors and the first reflector.

24. The passive repeater garment of claim 23, wherein the plurality of directors are arranged so that the respective distance between adjacent directors decreases between successive pairs of directors, starting from the distance between the first of the plurality of directors immediately adjacent to one of the first and second antennas.

25. The passive repeater garment of claim 23, wherein the plurality of directors are arranged so that the respective distance between adjacent directors increases, starting from the distance between the first of the plurality of directors immediately adjacent to one of the first and second antennas.

26. The passive repeater garment of claim 23, wherein the plurality of directors are configured so that the length of a particular director is shorter than the immediately adjacent director, starting from the first of the plurality of directors immediately adjacent to one of the first and second antennas.

27. The passive repeater garment of claim 23, wherein the plurality of directors are configured so that the length of a particular director is longer than the immediately adjacent director, starting from the first of the plurality of directors immediately adjacent to one of the first and second antennas.

28. The passive repeater garment of claim 4, further comprising:

a) a second insulation layer disposed on the second face of the electromagnetically reflective layer; and b) a second arrangement of conductors disposed on the second insulation layer, the second arrangement of conductors comprising:

a second resonator including a third antenna having a respective feed point, a fourth antenna having a respective feed point, and a second coupling element electrically connecting the respective feed points of the third and fourth antennas; and a second reflector electrically isolated from the second resonator and positioned adjacent to at least one of the third and fourth antennas, and wherein a longitudinal axis of the second reflector intersects the second coupling element.

29. The passive repeater garment of claim 28, wherein the second insulation layer is dielectric.

30. The passive repeater garment of claim 28, wherein the at least one antenna apparatus further comprises a second protective cover layer, which is disposed on a second face of the second insulation layer, such that the second arrangement of conductors is disposed between the second insulation layer and the second protective cover layer, wherein the second protective cover layer is non-conductive.

31. The passive repeater garment of claim 28, wherein the second arrangement of conductors is made from conductive threads.

32. The passive repeater garment of claim 31, further comprising:

a first antenna layer; and a second antenna layer;

wherein the first arrangement of conductors is made from conductive threads;

wherein the first antenna layer is non-conductive and flexible, such that the first antenna layer is disposed on a first face of the first insulation layer, wherein the conductive threads are sewn onto the first antenna layer;

wherein the second antenna layer is non-conductive and flexible, such that the second antenna layer is disposed on a second face of the second insulation layer, wherein the conductive threads are sewn onto the second antenna layer.

33. The passive repeater garment of claim 28, further comprising:

a) a conductive connector extending through the first insulation layer, the electromagnetically reflective layer and the second insulation layer, the conductive connector electrically connecting the first and second coupling elements; and b) a dielectric separator interposed between the electromagnetically reflective layer and the conductive connector electrically isolating the electromagnetically reflective layer and the conductive connector.

34. A passive repeater garment comprising:

a) a clothing item, which is configured to be worn on the body of a human;

b) at least one antenna apparatus, comprising:

an electromagnetically reflective layer;

an insulation layer on the electromagnetically reflective layer;

a plurality of antennas arranged on the insulation layer in a respective plurality of directions, each of the plurality of antennas having a feed point;

at least one coupling element, wherein each coupling element electrically connects the respective feed points of a respective pair of antennas; and at least one reflector electrically isolated from the plurality of antennas and positioned adjacent to at least one of the plurality of antennas, and wherein a respective longitudinal axis of the at least one reflector intersects the first coupling element;

wherein each of the plurality of antennas, the at least one coupling element, and the at least one reflector are made from conductive threads, wherein the conductive threads are sewn onto the insulation layer;

such that the at least one antenna apparatus is configured as a passive repeater.

35. The passive repeater garment of claim 33, wherein each of the plurality of antennas is a folded dipole antenna, and the respective feed point for each antenna comprises first and second feed terminals, and wherein each coupling element includes first and second conductive traces, the first conductive trace electrically connecting the respective first feed terminals of a pair of antennas, and the second conductive trace electrically connecting the respective second feed terminals of the same pair of antennas.

36. A system of passive repeater garments, comprising:

at least two personal assemblies of passive repeater garments;

wherein the at least two personal assemblies each comprise at least one passive repeater garment;

wherein the at least one passive repeater garments comprises:

a) a clothing item, which is configured to be worn on the body of a human; and b) at least one antenna apparatus, comprising:

i. an electromagnetically reflective layer, the electromagnetically reflective layer having first and second faces;

ii. a first insulation layer disposed on the first face of the electromagnetically reflective layer; and iii. a first arrangement of conductors disposed on the first insulation layer, the first arrangement of conductors comprising:

a first resonator, including:

a first antenna having a respective feed point, a second antenna having a respective feed point, and a first coupling element electrically connecting the respective feed points of the first and second antennas; and a first reflector, which is electrically isolated from the first resonator and positioned adjacent to at least one of the first and second antennas, and wherein a longitudinal axis of the first reflector intersects the first coupling element;

wherein the at least one antenna apparatus is mounted to the clothing item; such that the at least one antenna apparatus is configured as a passive repeater.

* * * * *